US011159905B2

(12) United States Patent
Namba et al.

(10) Patent No.: US 11,159,905 B2
(45) Date of Patent: Oct. 26, 2021

(54) SIGNAL PROCESSING APPARATUS AND METHOD

(71) Applicant: SONY CORPORATION, Tokyo (JP)

(72) Inventors: Ryuichi Namba, Tokyo (JP); Masashi Fujihara, Kanagawa (JP); Makoto Akune, Tokyo (JP); Koyuru Okimoto, Tokyo (JP); Toru Chinen, Kanagawa (JP); Kohei Asada, Kanagawa (JP); Kazunobu Ookuri, Kanagawa (JP); Masayoshi Noguchi, Chiba (JP); Minoru Tsuji, Chiba (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 17/040,321

(22) PCT Filed: Mar. 15, 2019

(86) PCT No.: PCT/JP2019/010763
§ 371 (c)(1),
(2) Date: Sep. 22, 2020

(87) PCT Pub. No.: WO2019/188394
PCT Pub. Date: Oct. 3, 2019

(65) Prior Publication Data

US 2021/0029485 A1 Jan. 28, 2021

(30) Foreign Application Priority Data

Mar. 30, 2018 (JP) ..... JP2018-068490

(51) Int. Cl.
*H04S 7/00* (2006.01)
*H04R 1/40* (2006.01)
(Continued)

(52) U.S. Cl.
CPC ..... *H04S 7/302* (2013.01); *H04R 1/40* (2013.01); *H04R 3/12* (2013.01); *H04R 5/04* (2013.01)

(58) Field of Classification Search
CPC .... H04S 7/00; H04R 5/04; H04R 3/12; H04R 1/40
(Continued)

(56) References Cited

U.S. PATENT DOCUMENTS

2004/0156616 A1* 8/2004 Strub ..... G11B 27/3027 386/224
2005/0135633 A1* 6/2005 Denmark, Jr. ..... H04R 1/02 381/77
(Continued)

FOREIGN PATENT DOCUMENTS

CN 101911723 A 12/2010
EP 2245862 A1 11/2010
(Continued)

OTHER PUBLICATIONS

International Search Report and Written Opinion of PCT Application No. PCT/JP2019/010763, dated May 28, 2019, 07 pages of ISRWO.

*Primary Examiner* — Melur Ramakrishnaiah
(74) *Attorney, Agent, or Firm* — Chip Law Group

(57) ABSTRACT

The present technology relates to a signal processing apparatus and method that are capable of reproducing sound at an optional listening position with a high sense of reality. The signal processing apparatus includes a rendering unit that generates reproduction data of sound at an optional listening position in a target space on the basis of recording signals of microphones attached to a plurality of moving bodies in the target space. The present technology can be applied to a reproduction apparatus.

10 Claims, 14 Drawing Sheets

(51) Int. Cl.
*H04R 3/12* (2006.01)
*H04R 5/04* (2006.01)

(58) Field of Classification Search
USPC ..... 700/94; 381/303, 23, 17–18, 92, 119
See application file for complete search history.

(56) References Cited

U.S. PATENT DOCUMENTS

| | | | | |
|---|---|---|---|---|
| 2009/0190769 | A1 | 7/2009 | Wang et al. | |
| 2016/0212562 | A1* | 7/2016 | Ojanpera | H04R 3/005 |
| 2016/0300577 | A1* | 10/2016 | Fersch | H04R 3/12 |
| 2017/0229149 | A1* | 8/2017 | Rothschild | G16H 40/63 |

FOREIGN PATENT DOCUMENTS

| | | | |
|---|---|---|---|
| JP | 09-182044 | A | 7/1997 |
| JP | 2007-318373 | A | 12/2007 |
| JP | 2014-045507 | A | 3/2014 |
| KR | 10-2010-0115783 | A | 10/2010 |
| WO | 2009/097417 | A1 | 8/2009 |
| WO | 2015/162947 | A1 | 10/2015 |

* cited by examiner

SIGNAL PROCESSING APPARATUS AND METHOD

CROSS REFERENCE TO RELATED APPLICATIONS

This application is a U.S. National Phase of International Patent Application No. PCT/JP2019/010763 filed on Mar. 15, 2019, which claims priority benefit of Japanese Patent Application No. JP 2018-068490 filed in the Japan Patent Office on Mar. 30, 2018. Each of the above-referenced applications is hereby incorporated herein by reference in its entirety.

TECHNICAL FIELD

The present technology relates to a signal processing apparatus and method, and a program, and more particularly, to a signal processing apparatus and method, and a program that are capable of reproducing sound at an optional listening position with a high sense of reality.

BACKGROUND ART

For example, in reproduction of content related to a space, such as soccer or a concert, if sound heard at an optional listening position in the space, that is, a sound field can be reproduced, content reproduction with a high sense of reality can be achieved.

Examples of the techniques related to sound recording for a general wide field (space) include surround sound collection in which microphones are disposed at a plurality of fixed positions in a concert hall or the like to perform recording, gun microphone collection from a distance, and application of beamforming to sound recorded by a microphone array.

Additionally, there is proposed a system in which, when a plurality of speakers is present in a space, sound is collected by microphones for each of the speakers, and the recorded sound for each of the speakers is recorded in association with positional information of the speaker, to achieve sound image localization corresponding to a listening position in the space (for example, see Patent Literature 1).

Further, in the sound field reproduction at a free viewpoint such as an omnidirectional view, a bird view, or a walk-through view, there are known sound collection by a plurality of surround microphones installed at wide intervals, omnidirectional sound collection using a spherical microphone array in which a plurality of microphones is disposed in a spherical shape, and the like. For example, the omnidirectional sound collection involves decomposition and reconstruction into Ambisonics. The simplest one is to collect sound using three microphones provided in a video camera or the like and obtain 5.1 channel surround-sound.

CITATION LIST

Patent Literature

Patent Literature 1: WO 2015/162947

DISCLOSURE OF INVENTION

Technical Problem

However, the above-mentioned techniques have had difficulty of reproducing sound at an optional listening position in a space with a high sense of reality.

For example, in the technique related to the sound recording for a general wide field, a distance from a sound source to a sound collection position may be large. In such a case, the sound quality is lowered due to the limit of the signal-to-noise ratio (SN ratio) performance of the microphone per se, thereby decreasing the sense of reality. In addition, if the distance from the sound source to the sound collection position is large, the decrease in clarity of the sound due to the influence of reverberation is not negligible in some cases. Although a reverberation removing technique for eliminating reverberation components from recorded sound is also known, such reverberation elimination technique has a limit in eliminating the reverberation components.

Additionally, when a recording engineer manually changes an orientation of a microphone with respect to the movement of a sound source, there is also a limit in changing a sound collection direction by carrying out an accurate rotation operation for a microphone by human power. This makes it difficult to achieve sound reproduction with a high sense of reality.

Further, also in the case of applying beamforming to the recorded sound obtained by the microphone array, there is a limit in tracking capability with respect to the movement of a sound source when the sound source is moving. This makes it difficult to achieve sound reproduction with a high sense of reality.

Moreover, in this case, in order to make the sound source in a predetermined direction to have an equal phase by the beamforming for the purpose of emphasis, it is necessary to take as large an opening portion of the microphone as possible in the low frequency range, and thus the apparatus is extremely enlarged. In addition, is a case where the beamforming is performed, the calibration becomes more complicated as the number of microphones increases, and in reality, only the emphasis of the sound source in a fixed direction can be performed.

Additionally, in the technique described in Patent Literature 1, it is not assumed that a speaker moves. In content in which a sound source moves, the sound reproduction with a sufficiently high sense of reality cannot be performed.

Further, also in the sound field reproduction at a free viewpoint, it is difficult to record sound of a sound source located at a distance due to the limitation of the SN ratio performance of the microphone, similarly to the above-mentioned case of the technique related to the sound recording for a general wide field. Therefore, the sound at an optional listening position has been hardly reproduced with a high sense of reality.

The present technology has been made in view of such circumstances and allows sound at an optional listening position in a space to be reproduced with a high sense of reality.

Solution to Problem

A signal processing apparatus according to one aspect of the present technology includes a rendering unit that generates reproduction data of sound at an optional listening position in a target space on the basis of recording signals of microphones attached to a plurality of moving bodies in the target space.

A signal processing method or a program according to one aspect of the present technology includes the step of generating reproduction data of sound at an optional listening position in a target space on the basis of recording signals of microphones attached to a plurality of moving bodies in the target space.

In one aspect of the present technology, the sound reproduction data of the sound at the optional listening position in the target space is generated on the basis of the recording signals of the microphones attached to the plurality of moving bodies in the target space.

Advantageous Effects of Invention

According to one aspect of the present technology, the sound at the optional listening position in the space can be reproduced with a high sense of reality.

Note that the effects described herein are not necessarily limitative, and any of the effects described in the present disclosure may be provided.

FIRST EMBODIMENT

Figure 1:
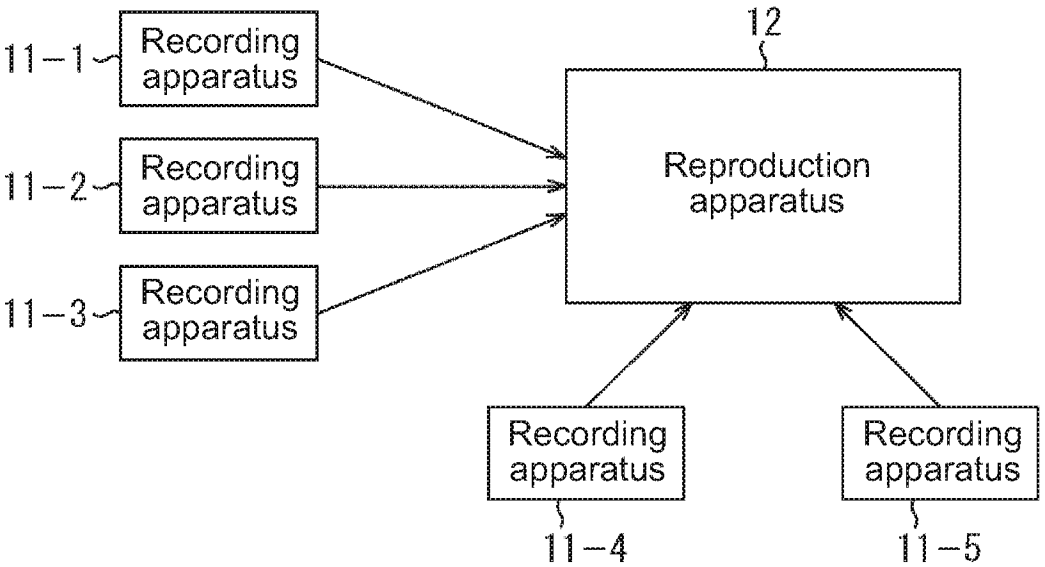
FIG. 1 is a diagram showing a configuration example of a sound field reproduction system.

<Configuration Example of Sound Field Reproduction System>

In the present technology, a plurality of moving bodies is provided with microphones and ranging devices in a target space, information regarding sound, a position, a direction, and movement (motion) of each moving body is acquired, and the acquired pieces of information are combined on a reproduction side, whereby sound at an optional position serving as a listening position in the space is reproduced in a pseudo manner. In particular, the present technology allows sound (sound field), which would be heard by a virtual listener when the virtual listener at an optional listening position faces in an optional direction, to be reproduced in a pseudo manner.

The present technology can be applied to, for example, a sound field reproduction system such as a virtual reality (VR) free viewpoint service that records sound (sound field) at each position in a space and reproduces sound at an optional listening position in the space in a pseudo manner on the basis of the recorded sound.

Specifically, in the sound field reproduction system to which the present technology is applied, one microphone array including a plurality of microphones or microphone arrays, which is dispersedly disposed in the space for sound field recording, is used to record sound at a plurality of positions in the space.

Here, at least some of the microphones or microphone arrays for sound collection are attached to a moving body that moves in the space.

Note that in the following description, for the sake of simplicity of description, it is assumed that sound collection at one position in a space is performed by a microphone array and that the microphone array is attached to a moving body. Further, hereinafter, a recording signal that is a signal of sound collected by the microphone array attached to the moving body (recorded sound), and more particularly, a recording signal that is a signal of recorded sound will also be referred to as an object.

In each moving body, not only the microphone array for sound collection, but also a ranging device such as a global positioning system (GPS) or a 9-axis sensor are attached thereto, and moving body position information, moving body orientation information, and sound collection position movement information about the moving body are also acquired.

Here, the moving body position information is information indicating the position of the moving body in a space, and the moving body orientation information is information indicating a direction in which the moving body faces in the space, more particularly, a direction in which the microphone array attached to the moving body faces. For example, the moving body orientation information is an azimuth angle indicating a direction in which the moving body faces when a predetermined direction in the space is set as a reference.

In addition, the sound collection position movement information is information regarding the motion (movement) of the moving body, such as a movement speed of the moving body or an acceleration at the time of movement. Hereinafter, information including the moving body position information, the moving body orientation information, and the sound collection position movement information will also be referred to as moving body-related information.

When the object and the moving body-related information are acquired for each moving body, object transmission data including the object and the moving body-related information is generated and transmitted to the reproduction side. On the reproduction side, signal processing or rendering is performed as appropriate on the basis of the received object transmission data, and reproduction data is generated.

In the rendering, audio data in a predetermined format such as the number of channels specified by a user (listener), is generated as reproduction data. The reproduction data is audio data for reproducing sound that would be heard by a virtual listener who has an optional listening position in a space and faces in an optional listening direction at that listening position.

For example, rendering and reproduction of a recording signal of a stationary microphone, including a microphone attached to a stationary object, is generally known. It is also generally known to render an object prepared for each sound source type as processing on the reproduction side.

The present technology differs from the rendering and reproduction of recorded signals of these stationary microphones or the rendering for each sound source type, in particular, in that a microphone array is attached to a moving body to collect (record) sound of an object and acquire the moving body-related information.

In such a manner, it is possible to synthesize a sound field by combining the objects and the pieces of moving body-related information obtained in respective moving bodies.

Additionally, in the rendering, a priority corresponding to a situation is calculated for each of the objects obtained by the plurality of moving bodies, and reproduction data can be generated using objects having a higher priority. Sound at an optional listening position can be reproduced with a higher sense of reality.

Note that while the generation of the reproduction data based on the priority will be described later, for example, it is conceivable to select an object of a moving body close to the listening position to generate reproduction data, or select an object of a moving body having a small amount of movement to generate reproduction data. For example, in the case of a moving body having a small amount of movement, an object having a small amount of noise caused by vibrations or the like of the moving body, that is, an object having a high signal-to-noise ratio (SN ratio) can be obtained, so that it is possible to obtain high-quality reproduction data.

Further, as an example of a moving body to which a microphone array or a ranging device is attached, a player of sports such as soccer is conceivable. Additionally, as a specific target of the sound collection (recording), that is, the content accompanied by sound, for example, the following targets (1) to (4) are conceivable.

Target (1)

Recording of team sports

Target (2)

Recording for a space where performances such as musicals, operas, and theatrical performances are performed Target (3)

Recording for an optional space in live venues or theme parks

Target (4)

Recording for bands such as orchestras and marching bands

For example, in the above target (1), a player may be assumed as a moving body, and a microphone array or a ranging device may be attached to the player. Similarly, in the targets (2) to (4), performers or audience may be assumed as moving bodies, and microphone arrays or ranging devices may be attached to the performers or the audience. Additionally, for example, in the target (3), recording may be performed at a plurality of locations.

Hereinafter, more specific embodiments of the present technology will be described.

FIG. 1 is a diagram showing a configuration example of an embodiment of a sound field reproduction system to which the present technology is applied.

The sound field reproduction system shown in FIG. 1 is to record sound at each position in a target space, set an optional position in the space as a listening position, and reproduce sound (sound field) that would be heard by a virtual listener facing in an optional direction at the listening position.

Note that, hereinafter, a space in which sound is to be recorded is also referred to as a recording target space, and a direction in which a virtual listener at a listening position faces is also referred to as a listening direction.

The sound field reproduction system of FIG. 1 includes recording apparatus 11-1 to the recording apparatus 11-5 and a reproduction apparatus 12.

The recording apparatus 11-1 to the recording apparatus 11-5 each include a microphone array or a ranging device and are each attached to a moving body in a recording target space. Thus, the recording apparatus 11-1 to the recording apparatus 11-5 are discretely disposed in the recording target space.

The recording apparatus 11-1 to the recording apparatus 11-5 each record an object and acquire moving body-related information, for the moving body to which the recording apparatus itself is attached, and generate object transmission data including the object and the moving body-related information.

The recording apparatus 11-1 to the recording apparatus 11-5 each transmit the generated object transmission data to the reproduction apparatus 12 by wireless communication.

Note that if the recording apparatus 11-1 to the recording apparatus 11-5 do not need to be distinguished from one another hereinafter, the recording apparatus 11-1 to the recording apparatus 11-5 will be simply referred to as recording apparatuses 11. Additionally, an example in which the recording of objects (recording of sound) at the positions of the respective moving bodies is performed by the five recording apparatuses 11 in the recording target space will be described here, but the number of recording apparatuses 11 may be any number.

The reproduction apparatus 12 receives the object transmission data transmitted from each recording apparatus 11, and generates reproduction data of a specified listening position and a specified listening direction on the basis of the object and the moving body-related information acquired for each moving body. Additionally, the reproduction apparatus 12 reproduces sound of the listening direction at the listening position on the basis of the generated reproduction data. Thus, content having the listening position and the listening direction serving as an optional position and an optional direction in the recording target space is reproduced.

For example, in a case where a sound recording target is sports, a field or the like in which the sports is to be performed is set as a recording target space, each player is set as a moving body, and the recording apparatus 11 is attached to each player.

Specifically, the recording apparatus 11 is attached to each player in a team sport played in a wide field, such as soccer, American football, rugby, or hockey, or in a competitive sport played in a wide environment, such as marathon.

The recording apparatus 11 includes a small microphone array, a ranging device, and a wireless transmission function. Additionally, in a case where the recording apparatus 11 includes storage, the object transmission data can be read from the storage after the end of the game or competition and supplied to the reproduction apparatus 12.

For example, in the recording from a position far from the recording target space, such as recording using a gun microphone from the outside of a wide field, it is difficult to collect sound in the vicinity of players due to the SN ratio limit of the microphone, and the sound field cannot be reproduced with a high sense of reality.

Meanwhile, in the sound field reproduction system to which the present technology is applied, each player is set as a moving body and an object is recorded. In particular, the recording apparatus 11 is attached to each player, and thus sound emitted by the player, walking sound, ball kick sound, and the like of the player can be recorded at a high SN ratio in a short distance from the player.

Therefore, by reproduction of the sound based on the reproduction data, a sound field that is heard by a listener facing in an optional direction (listening direction) at an optional viewpoint (listening position) in the area where the player exists can be artificially reproduced. This allows a sound field experience with a high sense of reality to be provided to a listener as if the listener were one of the players and were in the same field or the like with the players.

The object, which is recorded sound acquired for one moving body, i.e., one player, is sound in which not only voice and operation sound of the player but also sound and cheers of players in the vicinity are mixed.

Additionally, since the players move within the recording target space over time, the positions of the players, the relative distances between the players, and the directions in which the players are facing constantly fluctuate.

For that reason, in the recording apparatus 11, time-series data of the moving body position information, the moving body orientation information, and the sound collection position movement information is obtained as moving body-related information about the player (moving body). Such time series data may be smoothed in the time direction as necessary.

The reproduction apparatus 12 calculates the priority of each object on the basis of the moving body-related information of each moving body thus obtained or the like, and generates reproduction data by, for example, weighting and adding a plurality of objects in accordance with the obtained priority.

The reproduction data obtained in such a manner is audio data for reproducing in a pseudo manner the sound field that would be heard by a listener facing in an optional listening direction at an optional listening position.

Note that when the recording apparatus 11, more specifically, the microphone array of the recording apparatus 11 is attached to the player serving as a moving body, if microphones are attached at the positions of both ears of the player, binaural sound collection is performed. However, even when the microphone is attached to a portion other than the both ears of the player, the sound field can be recorded by the recording apparatus 11 with substantially the same sound volume balance or sense of localization as the sound volume balance or sense of localization from each sound source listened to by the player.

Additionally, in the sound field reproduction system, a wide space is set as a recording target space, and a sound field is recorded at each of a plurality of positions. That is, sound field recording is performed by a plurality of recording apparatuses 11 located at respective positions in the recording target space.

Normally, in the sound field recording in the recording target space performed using an integrated single microphone array or the like, if there is contact or the like between the microphone array and another object, noise of a signal due to the contact is mixed into the recorded signal obtained by recording in each of all the microphones constituting the microphone array.

Similarly, in the sound field reproduction system, for example, if there is contact between players, it is highly likely that noise due to vibrations of the contact is mixed into the objects obtained by the recording apparatuses 11 attached to those players.

However, in the sound field reproduction system, since the sound field recording is performed by the plurality of recording apparatuses 11, even at the timing when there is contact between players, there is a high possibility that noise due to vibrations of the contact between the players is not mixed into the objects obtained by the recording apparatuses 11 attached to other non-contact players. Thus, in the recording apparatus 11 attached to a player without contact, a high-quality object without contamination of noise sound can be obtained.

In the sound field reproduction system as described above, attaching the recording apparatuses 11 to a plurality of moving bodies leads to a risk distribution of noise contamination in a case where important target sound is to be recorded. Selecting and using an object having the best state, that is, an object including target sound of the best quality, among the objects obtained by the plurality of recording apparatuses 11, allows reproduction of sound having a high quality and a high sense of reality.

Further, in the sound field reproduction system, reproduction data of an optional listening position and listening direction is generated on the basis of the objects obtained by the recording apparatuses 11 discretely disposed in the recording target space. The reproduction data does not reproduce a completely physically correct sound field. However, in the sound field reproduction system, it is possible to appropriately reproduce a sound field of an optional listening position and listening direction in accordance with various circumstances in consideration of a priority, a listening position, a listening direction, a position and a direction of a moving body, and the like. In other words, in the sound field reproduction system, since the reproduction data is generated from the objects obtained by the recording apparatuses 11 discretely disposed, a sound field with a high sense of reality can be reproduced with a relatively high degree of freedom.

<Configuration Example of Recording Apparatus>

Next, specific configuration examples of the recording apparatus 11 and the reproduction apparatus 12 shown in FIG. 1 will be described. First, a configuration example of the recording apparatus 11 will be described.

Figure 2:
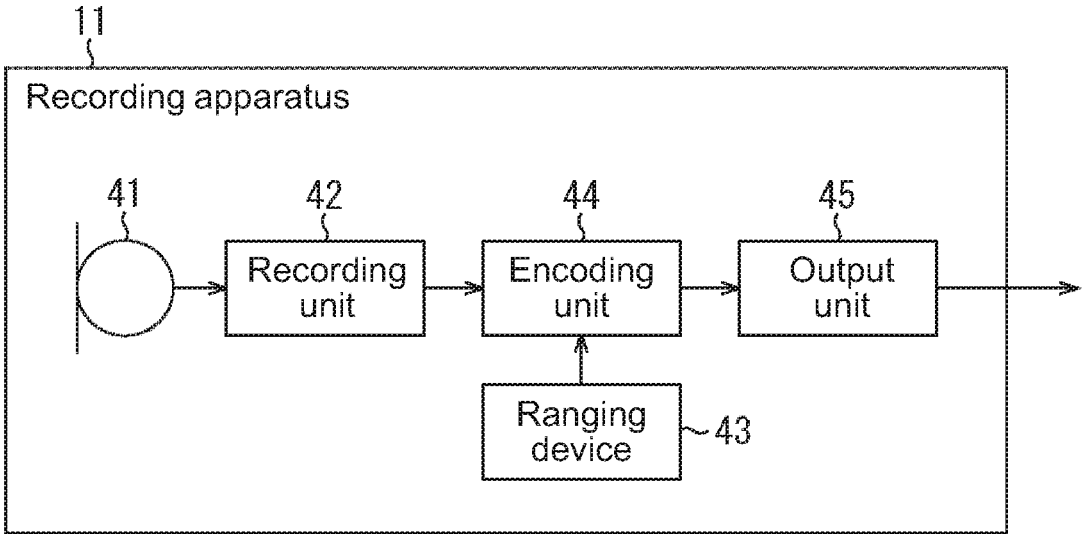
FIG. 2 is a diagram showing a configuration example of a recording apparatus.

The recording apparatus 11 is configured, for example, as shown in FIG. 2.

In the example shown in FIG. 2, the recording apparatus 11 includes a microphone array 41, a recording unit 42, a ranging device 43, an encoding unit 44, and an output unit 45.

The microphone array 41 collects ambient sound (sound field) around a moving body to which the recording apparatus 11 is attached, and supplies the resulting recording signal as an object to the recording unit 42.

The recording unit 42 performs analog-to-digital (AD) conversion or amplification processing on the object supplied from the microphone array 41, and supplies the obtained object to the encoding unit 44.

The ranging device 43 includes, for example, a position measuring sensor such as a GPS, the recording apparatus 11, i.e., a 9-axis sensor for measuring a movement speed and an acceleration of the moving body and a direction (orientation) in which the moving body faces, or the like.

The ranging device 43 measures, for the moving body to which the recording apparatus 11 is attached, moving body position information indicating a position of the moving body, moving body orientation information indicating a direction in which the moving body faces, i.e., an orientation of the moving body, and sound collection position movement information indicating a movement speed of the moving body and an acceleration at the time of movement, and supplies the measurement result to the encoding unit 44.

Note that the ranging device 43 may include a camera, an acceleration sensor, and the like. For example, in a case where the ranging device 43 includes a camera, the moving body position information, the moving body orientation information, and the sound collection position movement information can also be obtained from a video (image) captured by that camera.

The encoding unit 44 encodes the object supplied from the recording unit 42 and moving body-related information including the moving body position information, the moving body orientation information, and the sound collection position movement information supplied from the ranging device 43, and generates object transmission data.

In other words, the encoding unit 44 packs the object and the moving body-related information and generates the object transmission data.

Note that when the object transmission data is generated, the object and the moving body-related information may be compression-encoded or may be stored as it is in a packet of the object transmission data or the like.

The encoding unit 44 supplies the object transmission data generated by encoding to the output unit 45.

The output unit 45 outputs the object transmission data supplied from the encoding unit 44.

For example, in a case where the output unit 45 has a wireless transmission function, the output unit 45 wirelessly transmits the object transmission data to the reproduction apparatus 12.

Additionally, for example, in a case where the recording apparatus 11 includes storage, i.e., a storage unit such as a non-volatile memory, the output unit 45 outputs the object transmission data to the storage unit and records the object transmission data in the storage unit. In this case, at an optional timing, the object transmission data recorded in the storage unit is directly or indirectly read by the reproduction apparatus 12.

<Another Configuration Example of Recording Apparatus>

Additionally, in the recording apparatus 11, the object may be subjected to beamforming, which emphasizes the sound of a predetermined desired sound source, that is, target sound or the like, or subjected to noise reduction (NR) processing or the like.

Figure 3:
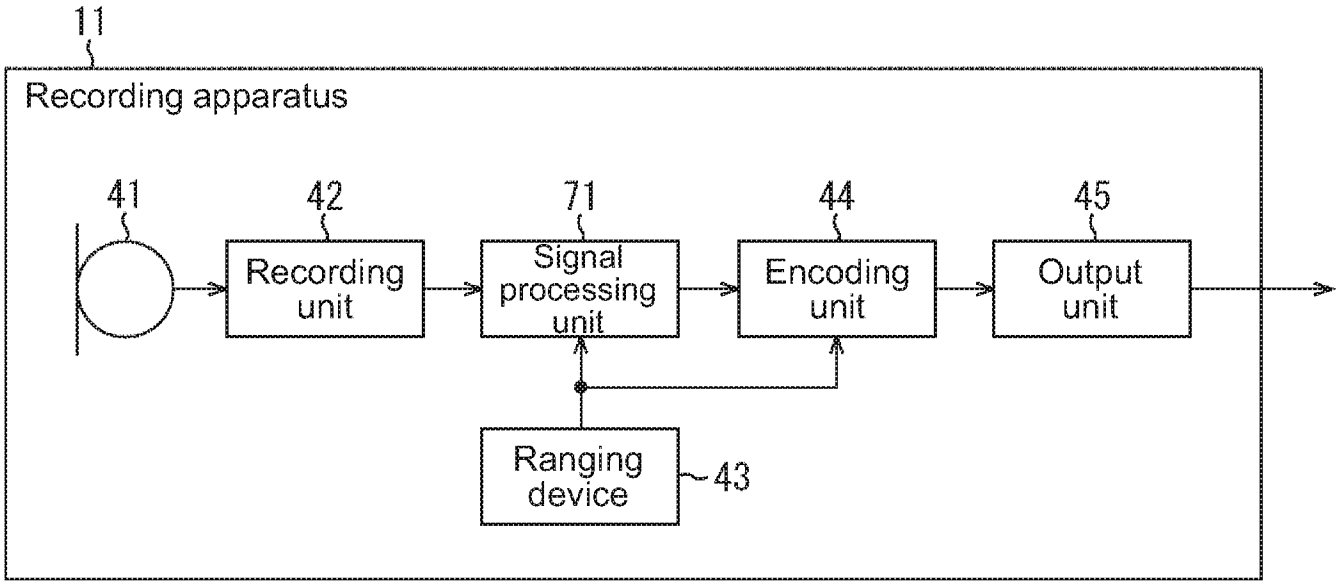
FIG. 3 is a diagram showing a configuration example of a recording apparatus.

In such a case, the recording apparatus 11 is configured as shown in FIG. 3, for example. Note that portions in FIG. 3 corresponding to those in FIG. 2 will be denoted by the same reference numerals, and description thereof will be omitted as appropriate.

The recording apparatus 11 shown in FIG. 3 includes a microphone array 41, a recording unit 42, a signal processing unit 71, a ranging device 43, an encoding unit 44, and an output unit 45.

The configuration of the recording apparatus 11 shown in FIG. 3 is a configuration in which the signal processing unit 71 is newly provided between the recording unit 42 and the encoding unit 44 of the recording apparatus 11 shown in FIG. 2.

The signal processing unit 71 performs beamforming or NR processing on the object supplied from the recording unit 42 by using the moving body-related information supplied from the ranging device 43 as necessary, and supplies the resulting object to the encoding unit 44.

Figure 4:
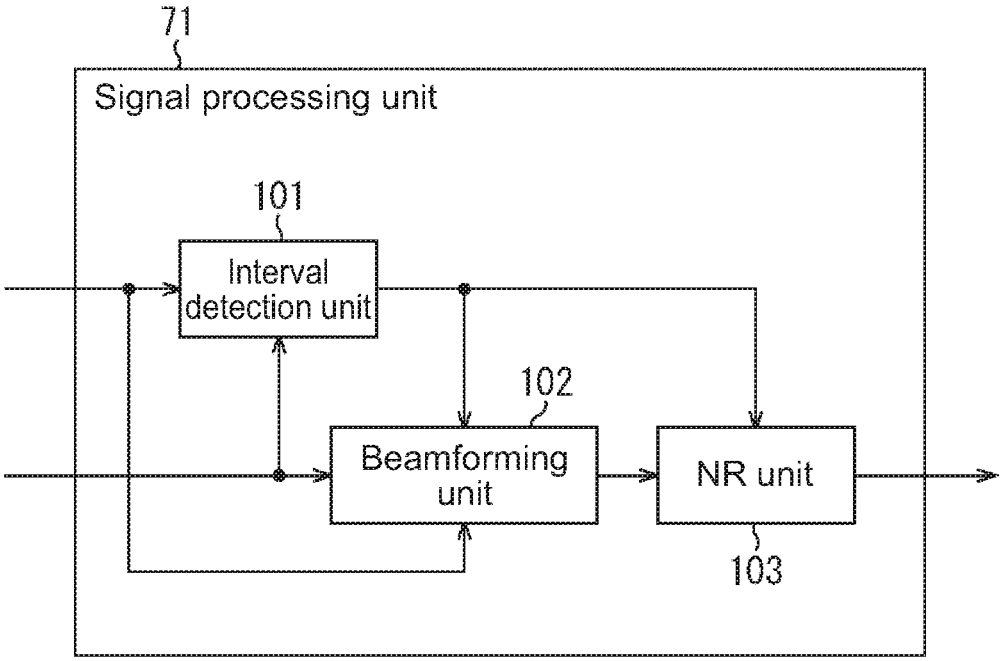
FIG. 4 is a diagram showing a configuration example of a signal processing unit.

Additionally, the signal processing unit 71 is configured as shown in FIG. 4, for example. That is, the signal processing unit 71 shown in FIG. 4 includes an interval detection unit 101, a beamforming unit 102, and an NR unit 103.

The interval detection unit 101 performs interval detection on the object supplied from the recording unit 42 by using the moving body-related information supplied from the ranging device 43 as necessary, and supplies the detection result to the beamforming unit 102 and the NR unit 103.

For example, the interval detection unit 101 includes a detector for a predetermined target sound and a detector for a predetermined non-target sound, and detects an interval of the target sound or the non-target sound in the object by an arithmetic operation based on the detectors.

The interval detection unit 101 then outputs, as a result of the interval detection, information indicating an interval in which each target sound or non-target sound in the object serving as a time signal is detected, i.e., information indicating an interval of the target sound or an interval of the non-target sound. In such a manner, in the interval detection, the presence or absence of the target sound or the non-target sound in each time interval of the object is detected.

Here, the predetermined target sound is, for example, a ball sound such as a kick sound of a soccer ball, an utterance of a player as a moving body, a foot sound (walking sound) of the player, or an operation sound such as a gesture.

In contrast to the above, the non-target sound is sound that is unfavorable as content sound or the like. Specifically, for example, the non-target sound includes a wind sound (wind noise), a rubbing sound of player's clothing, some vibration sounds, a contact sound between the player and another player or a matter, an environmental sound such as cheers, an utterance sound related to a strategy of a competition or privacy, an utterance sound of predetermined unfavorable no good words such as jeering, and other noise sounds (noises).

Additionally, when the interval is detected, the moving body-related information is used as necessary.

For example, if the sound collection position movement information included in the moving body-related information is referred to, it is possible to specify whether the moving body is moving or stationary. In this regard, for example, when the moving body is moving, the interval detection unit 101 detects a specific noise sound or determines an interval of the specific noise sound. Conversely, when the moving body is not moving, the interval detection unit 101 does not perform the detection of the specific noise sound or determines that it is not an interval of the specific noise sound.

Additionally, for example, in a case where the amount of movement or the like of the moving body is included as a parameter of the detectors for detecting the target sound and the non-target sound, the interval detection unit 101 obtains the amount of movement or the like of the moving body from the time-series moving body position information, time-series sound collection position movement information, and the like, and performs an arithmetic operation based on the detectors by using the amount of movement or the like.

The beamforming unit 102 performs beamforming on the object supplied from the recording unit 42, by using the result of the interval detection supplied from the interval detection unit 101 and the moving body-related information supplied from the ranging device 43 as necessary.

That is, for example, the beamforming unit 102 suppresses (reduces) a predetermined directional noise or emphasizes sound arriving from a specific direction by multi-microphone beamforming on the basis of the moving body orientation information or the like serving as the moving body-related information.

Additionally, in the multi-microphone beamforming, for example, an excessively large target sound such as a loud voice of the player included in the object or an unnecessary non-target sound such as environmental sound can be suppressed by reversing the phases of the components of such sound on the basis of the result of the interval detection. In addition, in the multi-microphone beamforming, for example, necessary target sound such as a kick sound of a ball included in the object can be emphasized by making the phases thereof equal on the basis of the result of the interval detection.

The beamforming unit 102 supplies the object, which is obtained by emphasizing or suppressing a predetermined sound source component by beamforming, to the NR unit 103.

The NR unit 103 performs NR processing on the object supplied from the beamforming unit 102 on the basis of the result of the interval detection supplied from the interval detection unit 101, and supplies the resulting object to the encoding unit 44.

For example, in the NR processing, among the components included in the object, the components of non-target sound or the like such as a wind sound, a rubbing sound of clothing, a relatively steady and unnecessary environmental sound, and predetermined noises are suppressed.

<Configuration Example of Reproduction Apparatus>

Subsequently, a configuration example of the reproduction apparatus 12 shown in FIG. 1 will be described.

Figure 5:
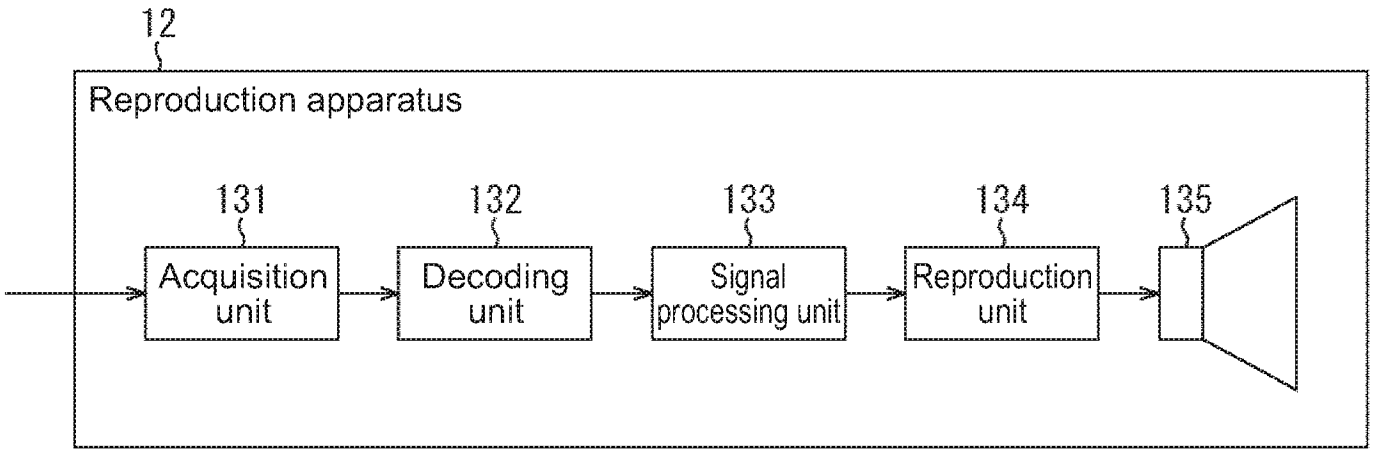
FIG. 5 is a diagram showing a configuration example of a reproduction apparatus.

For example, the reproduction apparatus 12 is configured as shown in FIG. 5.

The reproduction apparatus 12 is a signal processing apparatus that generates reproduction data on the basis of the acquired object transmission data. The reproduction apparatus 12 shown in FIG. 5 includes an acquisition unit 131, a decoding unit 132, a signal processing unit 133, a reproduction unit 134, and a speaker 135.

The acquisition unit 131 acquires the object transmission data output from the recording apparatus 11, and supplies the object transmission data to the decoding unit 132. The acquisition unit 131 acquires the object transmission data from all the recording apparatuses 11 in the recording target space.

For example, when the object transmission data is transmitted wirelessly from the recording apparatus 11, the acquisition unit 131 receives the object transmission data transmitted from the recording apparatus 11, thus acquiring the object transmission data.

Additionally, for example, when the object transmission data is recorded in the storage of the recording apparatus 11, the acquisition unit 131 acquires the object transmission data by reading the object transmission data from the recording apparatus 11. Note that in a case where the object transmission data is output from the recording apparatus 11 to an external apparatus or the like and held in the external apparatus, the object transmission data may be acquired by reading the object transmission data from that apparatus or the like.

The decoding unit 132 decodes the object transmission data supplied from the acquisition unit 131 and supplies the resulting object and moving body-related information to the signal processing unit 133. In other words, the decoding unit 132 extracts the object and the moving body-related information by performing unpacking of the object transmission data and supplies the extracted object and moving body-related information to the signal processing unit 133.

The signal processing unit 133 performs beamforming or NR processing on the basis of the moving body-related information and the object supplied from the decoding unit 132, generates reproduction data in a predetermined format, and supplies the reproduction data to the reproduction unit 134.

The reproduction unit 134 performs digital-to-analog (DA) conversion or amplification processing on the reproduction data supplied from the signal processing unit 133, and supplies the resulting reproduction data to the speaker 135. The speaker 135 reproduces a pseudo sound (simulated sound) in the listening position and the listening direction in the recording target space, on the basis of the reproduction data supplied from the reproduction unit 134.

Note that the speaker 135 may be a single speaker unit or may be a speaker array including a plurality of speaker units.

Additionally, while the case where the acquisition unit 131 to the speaker 135 are provided in a single apparatus will be described here, for example, a part of the blocks constituting the reproduction apparatus 12, such as the acquisition unit 131 to the signal processing unit 133, may be provided in another apparatus.

For example, the acquisition unit 131 to the signal processing unit 133 may be provided in a server on a network, and reproduction data may be supplied from the server to a reproduction apparatus including the reproduction unit 134 and the speaker 135. Alternatively, the speaker 135 may be provided outside the reproduction apparatus 12.

Further, the acquisition unit 131 to the signal processing unit 133 may be provided in a personal computer, a game machine, a portable device, or the like, or may be achieved by a cloud on the network.

Figure 6:
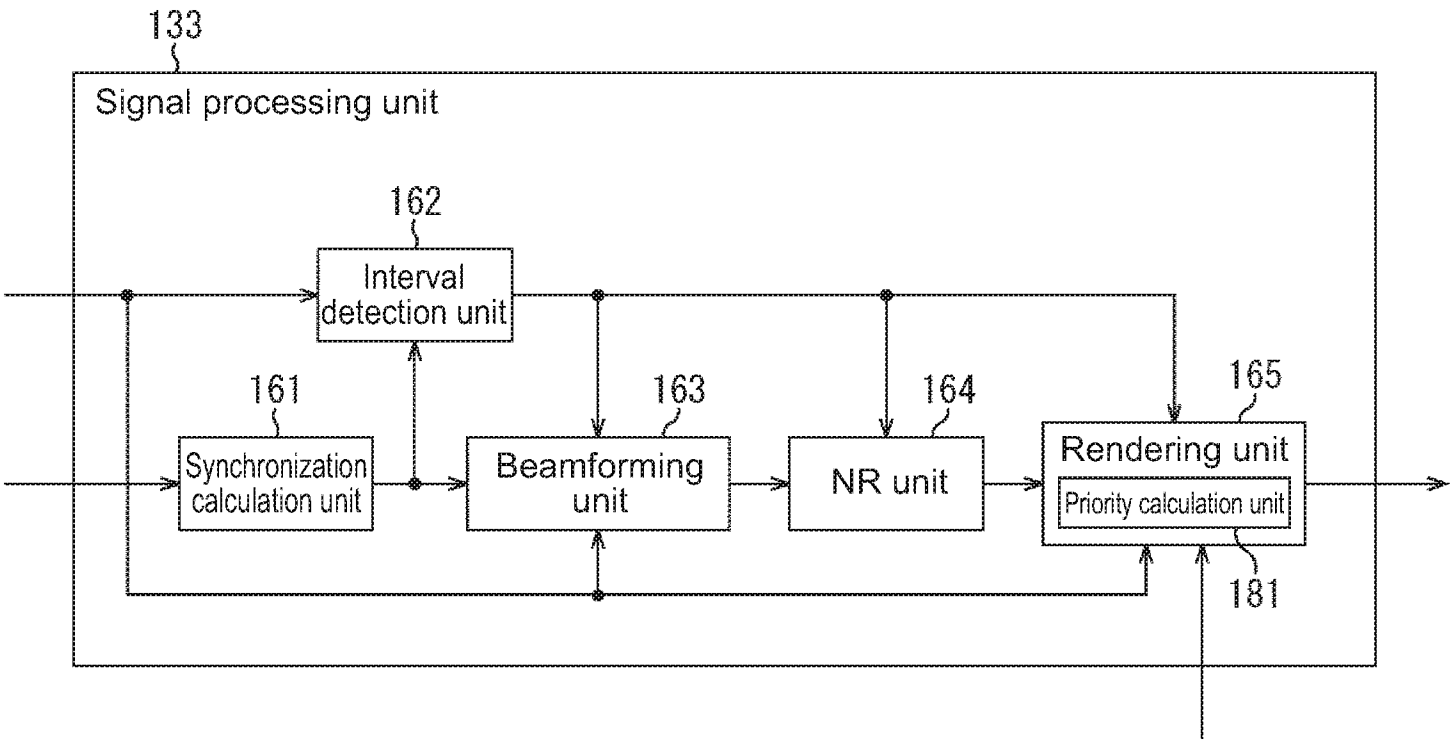
FIG. 6 is a diagram showing a configuration example of a signal processing unit.

Additionally, the signal processing unit 133 is configured, for example, as shown in FIG. 6.

The signal processing unit 133 shown in FIG. 6 includes a synchronization calculation unit 161, an interval detection unit 162, a beamforming unit 163, an NR unit 164, and a rendering unit 165.

The synchronization calculation unit 161 performs synchronization detection on the plurality of objects supplied from the decoding unit 132, synchronizes the objects of all the moving bodies on the basis of the detection result, and supplies the synchronized objects of the respective moving bodies to the interval detection unit 162 and the beamforming unit 163.

For example, in the synchronization detection, an offset between the microphone arrays 41 and a clock drift, which is the difference in clock cycle between the transmission side and the reception side of the object, i.e., the object transmission data, are detected. The synchronization calculation unit 161 synchronizes all the objects on the basis of the detection results of the offsets and the clock drifts.

For example, in the recording apparatus 11, the microphones constituting the microphone array 41 are synchronized with each other, and thus the processing of synchronizing the signals of the respective channels of the object is unnecessary. On the other hand, the reproduction apparatus 12 handles the objects obtained by the plurality of recording apparatuses 11, and thus needs to synchronize the objects.

The interval detection unit 162 performs interval detection on each object supplied from the synchronization calculation unit 161 on the basis of the moving body-related information supplied from the decoding unit 132, and supplies the detection result to the beamforming unit 163, the NR unit 164, and the rendering unit 165.

The interval detection unit 162 includes a detector for predetermined target sound or non-target sound and performs interval detection similar to that in the case of the interval detection unit 101 of the recording apparatus 11. In particular, the sound of a sound source to be the target sound or non-target sound in the interval detection unit 162 is the same as the sound of a sound source to be the target sound or non-target sound in the interval detection unit 101.

The beamforming unit 163 performs beamforming on each object supplied from the synchronization calculation unit 161, by using the result of the interval detection supplied from the interval detection unit 162 and the moving body-related information supplied from the decoding unit 132 as necessary.

That is, the beamforming unit 163 corresponds to the beamforming unit 102 of the recording apparatus 11, and performs the processing similar to that in the case of the beamforming unit 102 to suppresses or emphasizes the sound or the like of a predetermined sound source by beamforming.

Note that in the beamforming unit 163, basically, a sound source component similar to that in the case of the beamforming unit 102 is suppressed or emphasized. However, in the beamforming unit 163, the moving body-related information of another moving body can also be used in beamforming for an object of a predetermined moving body.

Specifically, for example, when there is another moving body near a moving body to be processed, a sound component of the other moving body, which is included in the object of the moving body to be processed, may be suppressed. In this case, for example, when a distance from the moving body to be processed to the other moving body obtained from the moving body position information of each moving body is equal to or smaller than a predetermined threshold value, the sound component of the other moving body may be suppressed by suppressing the sound arriving from a direction of the other moving body viewed from the moving body to be processed.

The beamforming unit 163 supplies the object, which is obtained by emphasizing or suppressing the predetermined sound source component by beamforming, to the NR unit 164.

The NR unit 164 performs NR processing on the object supplied from the beamforming unit 163 on the basis of the result of the interval detection supplied from the interval detection unit 162, and supplies the resulting object to the rendering unit 165.

For example, the NR unit 164 corresponds to the NR unit 103 of the recording apparatus 11, and performs NR processing similar to that in the case of the NR unit 103, to suppress the components of non-target sound or the like included in the object.

The rendering unit 165 generates reproduction data on the basis of the result of the interval detection supplied from the interval detection unit 162, the moving body-related information supplied from the decoding unit 132, listening-related information supplied from a higher-level control unit, and the object supplied from the NR unit 164, and supplies the reproduction data to the reproduction unit 134.

Here, the listening-related information includes, for example, listening position information, listening orientation information, listening position movement information, and desired sound source information, and is information specified by, for example, an operation input by the user.

The listening position information is information indicating a listening position in the recording target space, and the listening orientation information is information indicating a listening direction. Additionally, the listening position movement information is information related to the motion (movement) of a virtual listener in the recording target space, such as a listening position in the recording target space, i.e., a movement speed of the virtual listener in the listening position and an acceleration at the time of movement.

Further, the desired sound source information is information indicating a sound source of a component to be included in the sound to be reproduced by the reproduction data. For example, a player or the like as a moving body is specified as a sound source (hereinafter, also referred to as specified sound source) indicated by the desired sound source information. Note that the desired sound source information may be information indicating a position of the specified sound source in the recording target space.

The rendering unit 165 includes a priority calculation unit 181. The priority calculation unit 181 calculates the priority of each object.

For example, the priority of the object indicates that the object having a higher value of the priority is more important and has a higher priority at the time of generating the reproduction data.

In calculation of the priority, for example, the result of the interval detection, the moving body-related information, the listening-related information, the type of the NR processing in the NR unit 164, the sound pressure of the object, and the like are taken into account. That is, the priority calculation unit 181 calculates the priority of each object on the basis of at least one of the sound pressure of the object supplied from the NR unit 164, the result of the interval detection, the moving body-related information, the listening-related information, or the type of the NR processing performed by the NR unit 164.

As a specific example, for example, the priority calculation unit 181 increases the priority of the object of the moving body closer to the listening position on the basis of the listening position information and the moving body position information, or increases the priority of the object of the moving body closer to a predetermined position such as a position of a ball or a position of a specified sound source, which is specified by the user or the like, on the basis of the moving body position information or the like.

Additionally, for example, the priority calculation unit 181 increases the priority of an object interval including a component of a specified sound source indicated by the desired sound source information, on the basis of the result of the interval detection and the desired sound source information.

Further, for example, the priority calculation unit 181 increases the priority of the object of the moving body in which a direction indicated by the moving body orientation information, i.e., a direction in which the moving body faces, and the listening direction indicated by the listening orientation information face each other, on the basis of the moving body orientation information and the listening orientation information.

In addition, for example, the priority calculation unit 181 increases the priority of the object of the moving body approaching the listening position, on the basis of the moving body position information, the sound collection position movement information, the listening position information, the listening position movement information, and the like in time series.

Additionally, for example, the priority calculation unit 181 makes the priority higher for the object of the moving body having a small amount of movement or the object of the moving body having a lower movement speed, and makes the priority higher for the object of the moving body having a smaller acceleration, i.e., the object of the moving body having a smaller vibration, on the basis of the sound collection position movement information. This is because the moving body having a small amount of motion such as the amount of movement, a movement speed, and vibrations has less noise included in the recorded object, and has the component of the target sound at a higher SN ratio. In addition, since the object of the moving body having a small amount of motion has a small side effect such as a Doppler effect at the time of mixing (synthesis), the sound quality of the finally obtained reproduction data is improved.

Further, for example, the priority calculation unit 181 increases the priority of the object interval including the target sound and increases the priority of the object interval not including the non-target sound such as an utterance sound like no good words or a noise sound, on the basis of the result of the interval detection. In other words, the priority calculation unit 181 lowers the priority of the object interval including the non-target sound such as an unfavorable utterance sound or a noise sound. Note that the priority of the object interval including the target sound may be increased when the sound pressure of the object is equal to or higher than a predetermined sound pressure. In addition, in consideration of the distance attenuation, the priority of an object whose sound is estimated to be observed at a predetermined sound pressure or more at the listening position may be increased on the basis of the object, the moving body position information, and the listening position information. At this time, the priority of the object estimated to be able to observe only sound smaller than the predetermined sound pressure at the listening position may be lowered.

Additionally, for example, the priority calculation unit 181 lowers the priority of the object interval including a noise sound of a predetermined type that is hard to suppress (reduce), on the basis of the result of interval detection or the type of NR processing. In other words, the object having less noise has a higher priority. This is because the object interval including a noise sound of a type that is hard to suppress can be an interval having a low sound quality as compared to other intervals, because of including a noise sound that has not been removed even after the NR processing, or the quality deterioration due to the influence of the suppression of the noise sound.

When the priority is calculated for each object of the moving body, the rendering unit 165 selects an object to be used for rendering, i.e., an object to be used for generating the reproduction data, on the basis of the priority of each object.

Specifically, for example, a predetermined number of objects in descending order of priority may be selected as objects to be used for rendering. Additionally, for example, an object having a priority equal to or higher than a predetermined value may be selected as an object to be used for rendering.

Selecting an object to be used for rendering on the basis of the priority in such a manner allows selection of a high-quality object having a small amount of motion of the moving body and including the target sound at a high SN ratio. In other words, an object having less noise and a high sense of reality can be selected.

The rendering unit 165 performs rendering on the basis of one or more objects selected on the basis of the priority, and generates reproduction data of a predetermined number of channels. Note that an object selected on the basis of the priority and used for rendering is also hereinafter referred to as a selected object.

In the rendering, for example, for each selected object, a signal of each channel of the reproduction data (hereinafter also referred to as an object channel signal) is generated.

For example, the object channel signal may be generated by vector based amplitude panning (VBAP) or the like on the basis of the listening-related information, the moving body-related information, and speaker arrangement information indicating the arrangement positions of speaker units constituting a speaker array serving as the speaker 135.

If the object channel signal is generated by VBAP or the like, a sound image can be localized at an optional position in the recording target space. Thus, even when the listening position is, for example, a position without a player as a moving body, a sound field of the listening direction at the listening position can be reproduced in a pseudo manner. In particular, by using only the objects having a high priority, a sound field of a high quality, stability, and a high sense of reality can be reproduced.

For example, in the sound field reproduction at a general free viewpoint, it is difficult to simultaneously obtain reproduction of sound actually heard at an optional position and a sense of direction thereof. On the other hand, if the object channel signal is generated by VBAP or the like at the time of rendering, the sense of distance from each sound source to the listening position or the sense of direction can be obtained.

Additionally, when the object channel signal is obtained for each selected object, the rendering unit 165 performs mixing processing to synthesize the object channel signals of the respective selected objects, thereby generating reproduction data.

In other words, in the mixing processing, the object channel signals of the same channel of the respective selected objects are weighted and added by the weights of the respective selected objects to be obtained as the signals of the corresponding channels of the reproduction data. By such mixing processing as well, the sense of distance from each sound source to the listening position or the sense of direction can be obtained.

Here, the weight for each of the selected objects used in the mixing processing (hereinafter, also referred to as a composite weight) is dynamically determined for each of the intervals by the rendering unit 165 on the basis of, for example, at least one of the priority of the selected object, the sound pressure of the object supplied from the NR unit 164, the result of the interval detection, the moving body-related information, the listening-related information, or the type of the NR processing performed by the NR unit 164. Note that the composite weight may be determined for each of the channels in each interval of the selected object.

Specifically, for example, on the basis of the moving body position information and the listening position information, the selected object of the moving body closer to the listening position has a larger composite weight. In this case, the composite weight is determined in consideration of the distance attenuation from the position of the moving body to the listening position.

Additionally, for example, on the basis of the moving body orientation information and the listening orientation information, the composite weight is made larger for the selected object of the moving body in which a direction indicated by the moving body orientation information, in which the moving body faces, and the listening direction indicated by the listening orientation information face each other.

Further, for example, on the basis of the result of the interval detection and the desired sound source information, the composite weight of the selected object including the component of the specified sound source indicated by the desired sound source information is increased. At that time, the composite weight may be made larger for the selected object of the moving body having a larger sound pressure and a shorter distance to the listening position. In addition, for example, on the basis of the result of the interval detection or the type of the NR processing, the composite weight of the selected object including the noise sound of the type that is hard to suppress (reduce) is reduced.

As another example, in a case where reproduction data including sound of a specified sound source is desired to be obtained, an object obtained by the recording apparatus 11 located at the position closest to the specified sound source is assumed to be a selected object. In such a case, it is possible to increase the composite weight in the interval in which the sound of the specified sound source in the selected object is included as target sound, or set the composite weight to zero to mute the sound in the interval in which the sound of the specified sound source is not included as target sound.

Note that in this case, only the object obtained by the recording apparatus 11 located at the position closest to the specified sound source may be set as the selected object, or other objects may be selected as the selected objects.

The generation and mixing processing for the above object channel signal are performed as rendering processing, and reproduction data is generated. The rendering unit 165 supplies the obtained reproduction data to the reproduction unit 134.

<Another Configuration Example of Reproduction Apparatus>

Note that even when the recording apparatus 11 is configured as shown in FIG. 2 or FIG. 3, the reproduction apparatus 12 can be configured as shown in FIG. 5, but when the recording apparatus 11 is configured as shown in FIG. 3, the reproduction apparatus 12 does not need to perform beamforming or NR processing.

Figure 7:
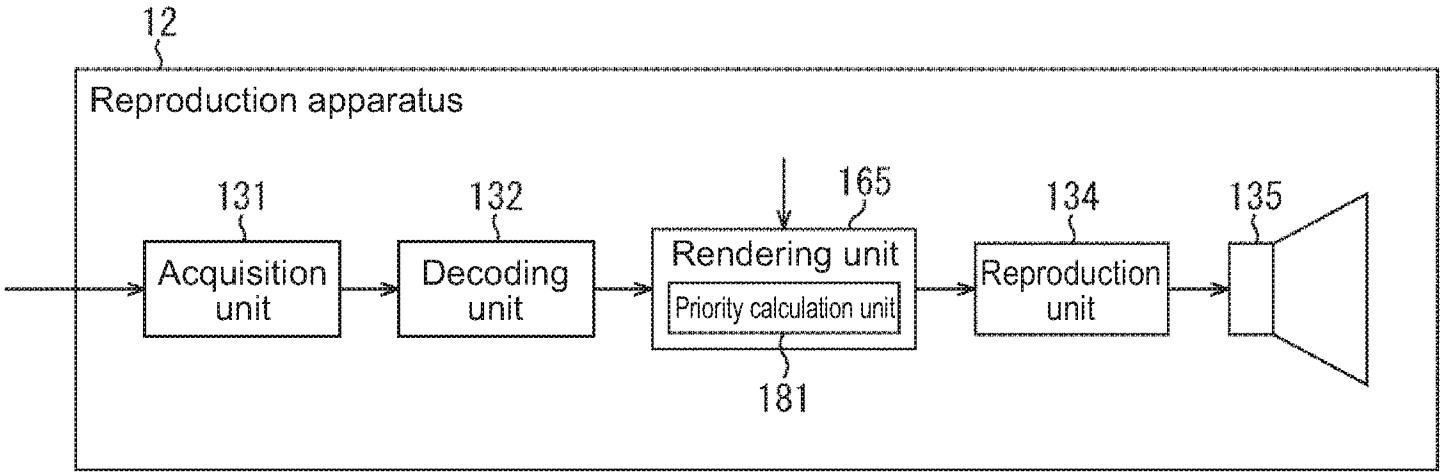
FIG. 7 is a diagram showing a configuration example of a reproduction apparatus.

Therefore, in a case where the recording apparatus 11 is configured as shown in FIG. 3, the reproduction apparatus 12 may also be configured as shown in FIG. 7, for example. Note that portions in FIG. 7 corresponding to those in FIG. 5 or FIG. 6 will be denoted by the same reference numerals, and description thereof will be omitted as appropriate.

In the example shown in FIG. 7, the reproduction apparatus 12 includes an acquisition unit 131, a decoding unit 132, a rendering unit 165, a reproduction unit 134, and a speaker 135.

The configuration of the reproduction apparatus 12 shown in FIG. 7 is a configuration including the rendering unit 165 instead of the signal processing unit 133 in the configuration of the reproduction apparatus 12 shown in FIG. 5.

Additionally, in the reproduction apparatus 12 shown in FIG. 7, the rendering unit 165 includes a priority calculation unit 181.

The priority calculation unit 181 of the rendering unit 165 calculates the priority of each object on the basis of the moving body-related information supplied from the decoding unit 132, the sound pressure of each object, and the listening-related information supplied from a higher-level control unit.

Additionally, the rendering unit 165 selects the selected object on the basis of the priority of each object, and also generates the reproduction data from the selected object by using the priority, the sound pressure of the object, the moving body-related information, and the listening-related information as necessary, to supply the reproduction data to the reproduction unit 134.

Note that in this example, the object transmission data output from the recording apparatus 11 may include not only the object and the moving body-related information but also information indicating the result of the interval detection in the interval detection unit 101, the type of the NR processing performed in the NR unit 103, or the like.

In such a case, the priority calculation unit 181 or the rendering unit 165 can use the information indicating the result of the interval detection or the type of the NR processing, which is supplied from the decoding unit 132, to calculate the priority and generate the reproduction data.

<Description of Recording Processing>

Subsequently, processing performed in the sound field reproduction system will be described.

First, the recording processing performed by each of the recording apparatuses 11 disposed in the recording target space will be described with reference to the flowchart of FIG. 8. Note that here, the recording apparatus 11 is assumed to have the configuration shown in FIG. 2.

In Step S11, the microphone array 41 records a sound field.

That is, the microphone array 41 collects ambient sound and supplies an object, which is a recording signal obtained as a result of the sound collection, to the recording unit 42. The recording unit 42 performs AD conversion, amplification processing, or the like on the object supplied from the microphone array 41, and supplies the obtained object to the encoding unit 44.

Additionally, when the recording by the microphone array 41 is started, the ranging device 43 starts measuring the position of the moving body or the like, and sequentially supplies the moving body-related information including the moving body position information, the moving body orientation information, and the sound collection position movement information, which are obtained as a result of the measurement, to the encoding unit 44. In other words, the ranging device 43 acquires the moving body-related information.

In Step S12, the encoding unit 44 encodes the object supplied from the recording unit 42 and the moving body-related information supplied from the ranging device 43 to generate object transmission data, and supplies the object transmission data to the output unit 45.

In Step S13, the output unit 45 outputs the object transmission data supplied from the encoding unit 44, and the recording processing is terminated.

For example, the output unit 45 outputs the object transmission data by wirelessly transmitting the object transmission data to the reproduction apparatus 12 or by supplying the object transmission data to the storage for recording.

As described above, the recording apparatus 11 records the sound field (sound) around itself and also acquires the moving body-related information, to output the object transmission data. In particular, in the sound field reproduction system, recording is performed in each of the recording apparatuses 11 discretely disposed in the recording target space, and the object transmission data is output. Thus, the reproduction apparatus 12 can reproduce sound of an optional listening position and listening direction with a high sense of reality by using the object obtained by each recording apparatus 11.

<Description of Reproduction Processing>

Additionally, when each recording apparatus 11 performs the recording processing described with reference to FIG. 8, the reproduction apparatus 12 performs reproduction processing shown in FIG. 9 in response to the recording processing.

The reproduction processing by the reproduction apparatus 12 will be described below with reference to the flowchart of FIG. 9. Note that in this case, the reproduction apparatus 12 is configured as shown in FIG. 5.

In Step S41, the acquisition unit 131 acquires the object transmission data and supplies the object transmission data to the decoding unit 132.

For example, when the object transmission data is transmitted wirelessly from the recording apparatus 11, the acquisition unit 131 acquires the object transmission data by receiving the object transmission data. Alternatively, for example, when the object transmission data is recorded in the storage of the recording apparatus 11 or in the storage of another apparatus such as a server, the acquisition unit 131 acquires the object transmission data by reading the object transmission data from the storage or receiving the object transmission data from the other apparatus such as a server.

The decoding unit 132 decodes the object transmission data supplied from the acquisition unit 131 and supplies the resulting object and moving body-related information to the signal processing unit 133. Thus, the objects and the pieces of moving body-related information obtained by all the recording apparatuses 11 in the recording target space are supplied to the signal processing unit 133.

In Step S42, the synchronization calculation unit 161 of the signal processing unit 133 performs synchronization processing of each object supplied from the decoding unit 132 and supplies each synchronized object to the interval detection unit 162 and the beamforming unit 163.

In the synchronization processing, an offset between the microphone arrays 41 or a clock drift is detected, and the output timing of the objects is adjusted such that the objects are synchronized on the basis of the detection result.

In Step S43, the interval detection unit 162 performs interval detection on each object supplied from the synchronization calculation unit 161 on the basis of the moving body-related information supplied from the decoding unit 132 and the detector of the target sound or the non-target sound that is held in advance, and supplies the detection result to the beamforming unit 163, the NR unit 164, and the rendering unit 165.

In Step S44, the beamforming unit 163 performs beamforming on each object supplied from the synchronization calculation unit 161 on the basis of the result of the interval detection supplied from the interval detection unit 162 and the moving body-related information supplied from the decoding unit 132. Thus, the component of a specific sound source in the object is emphasized or suppressed.

The beamforming unit 163 supplies the object obtained by the beamforming to the NR unit 164.

In Step S45, the NR unit 164 performs NR processing on the object supplied from the beamforming unit 163 on the basis of the result of the interval detection supplied from the interval detection unit 162, and supplies the resulting object to the rendering unit 165.

In Step S46, the priority calculation unit 181 of the rendering unit 165 calculates the priority of each object on the basis of the sound pressure of the object supplied from the NR unit 164, the result of the interval detection supplied from the interval detection unit 162, the moving body-related information supplied from the decoding unit 132, the listening-related information supplied from a higher-level control unit, and the type of the NR processing performed by the NR unit 164.

In Step S47, the rendering unit 165 performs rendering on the object supplied from the NR unit 164.

That is, the rendering unit 165 selects some of the objects supplied from the NR unit 164 as the selected objects on the basis of the priority calculated by the priority calculation unit 181. Additionally, the rendering unit 165 refers to the listening-related information and the moving body-related information as necessary for each of the selected objects, and generates an object channel signal.

Further, the rendering unit 165 determines (calculates) the composite weight for each interval of the selected object on the basis of the priority, the sound pressure of the selected object, the result of the interval detection, the moving body-related information, the listening-related information, the type of the NR processing performed by the NR unit 164, or the like. The rendering unit 165 then performs mixing processing for weighting and adding the object channel signals of the selected objects on the basis of the obtained composite weights to generate reproduction data, and supplies the reproduction data to the reproduction unit 134.

The reproduction unit 134 performs DA conversion and amplification processing on the reproduction data supplied from the rendering unit 165, and supplies the resulting reproduction data to the speaker 135.

In Step S48, the speaker 135 reproduces a pseudo sound in the listening position and the listening direction in the recording target space on the basis of the reproduction data supplied from the reproduction unit 134, and the reproduction processing is terminated.

As described above, the reproduction apparatus 12 calculates the priority of the object obtained by the recording in each recording apparatus 11, and selects an object to be used for generating the reproduction data. Additionally, the reproduction apparatus 12 generates the reproduction data on the basis of the selected object, and reproduces sound in the listening position and the listening direction in the recording target space.

In particular, in the reproduction apparatus 12, the calculation of the priority and the rendering are performed in consideration of the result of the interval detection, the moving body-related information, the listening-related information, the type of the NR processing performed by the NR unit 164, or the like. This allows sound in an optional listening position and listening direction to be reproduced with a high sense of reality.

<Description of Recording Processing>

Figure 8:
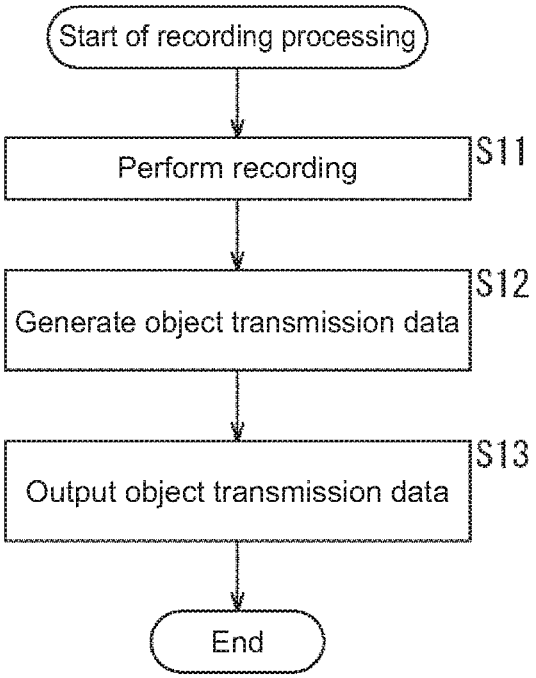
FIG. 8 is a flowchart for describing recording processing.

Note that in FIG. 8, the recording processing in a case where the beamforming and the NR processing are not performed in the recording apparatus 11 has been described.

Figure 10:
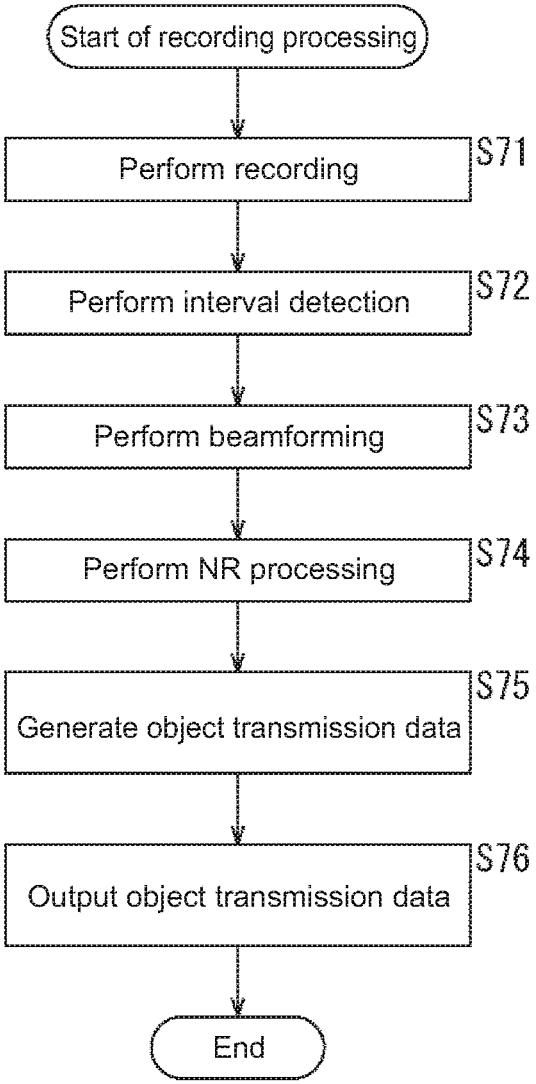
FIG. 10 is a flowchart for describing recording processing.

However, in a case where the recording apparatus 11 is configured as shown in FIG. 3, the beamforming and the NR processing are performed in the recording apparatus 11. That is, the recording processing shown in FIG. 10 is performed.

Hereinafter, the recording processing performed by the recording apparatus 11 shown in FIG. 3 will be described with reference to the flowchart of FIG. 10.

Note that the processing of Step S71 is similar to the processing of Step S11 of FIG. 8, and thus description thereof will be omitted. When the processing in Step S71 is performed to obtain an object, the object is supplied from the microphone array 41 to the interval detection unit 101 and the beamforming unit 102 of the signal processing unit 71 through the recording unit 42.

In Step S72, the interval detection unit 101 performs interval detection on the object supplied from the recording unit 42 on the basis of the moving body-related information supplied from the ranging device 43 and the detector of the target sound or the non-target sound that is held in advance, and supplies the detection result to the beamforming unit 102 and the NR unit 103.

In Step S73, the beamforming unit 102 performs beamforming on the object supplied from the recording unit 42 on the basis of the result of the interval detection supplied from the interval detection unit 101 and the moving body-related information supplied from the ranging device 43. Thus, the component of a specific sound source in the object is emphasized or suppressed.

The beamforming unit 102 supplies the object obtained by the beamforming to the NR unit 103.

In Step S74, the NR unit 103 performs NR processing on the object supplied from the beamforming unit 102 on the basis of the result of the interval detection supplied from the interval detection unit 101, and supplies the resulting object to the encoding unit 44.

Note that in this case, not only the object subjected to the NR processing but also information indicating the result of the interval detection obtained by the interval detection unit 101 or the type of the NR processing performed by the NR unit 103 may be supplied from the NR unit 103 to the encoding unit 44.

After the NR processing is performed in such a manner, the processing in Steps S75 and S76 is performed, and the recording processing is terminated. Such processing in Steps S75 and S76 is similar to the processing in Steps S12 and S13 in FIG. 8, and thus description thereof will be omitted.

However, in Step S75, in a case where the NR unit 103 supplies the encoding unit 44 with information indicating the result of the interval detection or the type of the NR processing performed by the NR unit 103, the encoding unit 44 generates object transmission data including not only the object and the moving body-related information but also the information indicating the result of the interval detection or the type of the NR processing performed by the NR unit 103.

In such a manner, the recording apparatus 11 performs beamforming and NR processing on the object obtained by recording to generate the object transmission data.

If each recording apparatus 11 performs beamforming and NR processing as described above, the reproduction apparatus 12 does not need to perform beamforming and NR processing on all the objects. This can reduce the processing load of the reproduction apparatus 12.

<Description of Reproduction Processing>

Figure 11:
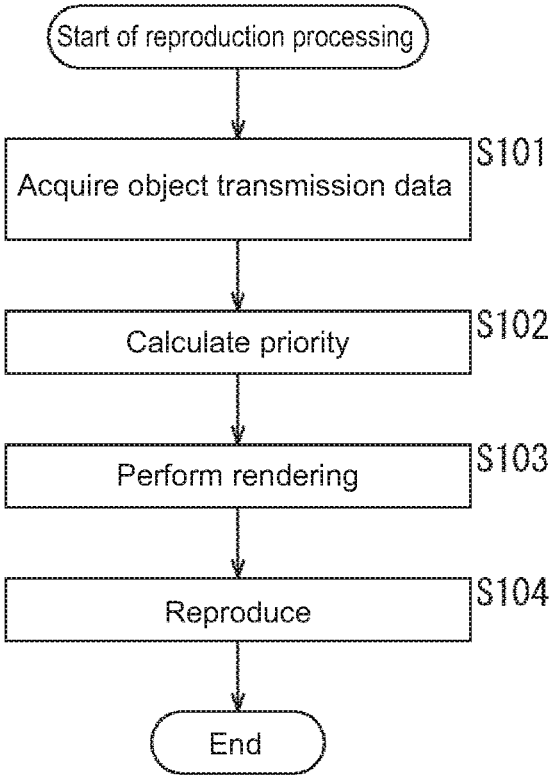
FIG. 11 is a flowchart for describing reproduction processing.

Additionally, when each recording apparatus 11 performs the recording processing described with reference to FIG. 10, the reproduction apparatus 12 performs reproduction processing shown in, for example, FIG. 11 in response to the recording processing.

The reproduction processing by the reproduction apparatus 12 will be described below with reference to the flowchart of FIG. 11. In this case, the reproduction apparatus 12 is configured as shown in FIG. 7.

When the reproduction processing is started, the processing of Step S101 is performed to acquire the object transmission data. Since the processing of Step S101 is similar to the processing of Step S41 of FIG. 9, description thereof will be omitted.

However, in the Step S101, when the object transmission data is acquired by the acquisition unit 131 and decoded by the decoding unit 132, the object and the moving body-related information obtained by the decoding are supplied from the decoding unit 132 to the rendering unit 165. Additionally, in a case where the object transmission data includes information indicating the result of the interval detection or the type of the NR processing performed by the NR unit 103, the information indicating the result of the interval detection or the type of the NR processing is also supplied from the decoding unit 132 to the rendering unit 165.

In Step S102, the priority calculation unit 181 of the rendering unit 165 calculates the priority of each object on the basis of the moving body-related information supplied from the decoding unit 132, the sound pressure of each object, and the listening-related information supplied from a higher-level control unit.

Note that when the information indicating the result of the interval detection or the type of the NR processing is supplied from the decoding unit 132, the priority calculation unit 181 calculates the priority by using the information indicating the result of the interval detection or the information indicating the type of the NR processing.

In Step S103, the rendering unit 165 performs rendering on the object supplied from the decoding unit 132.

Figure 9:
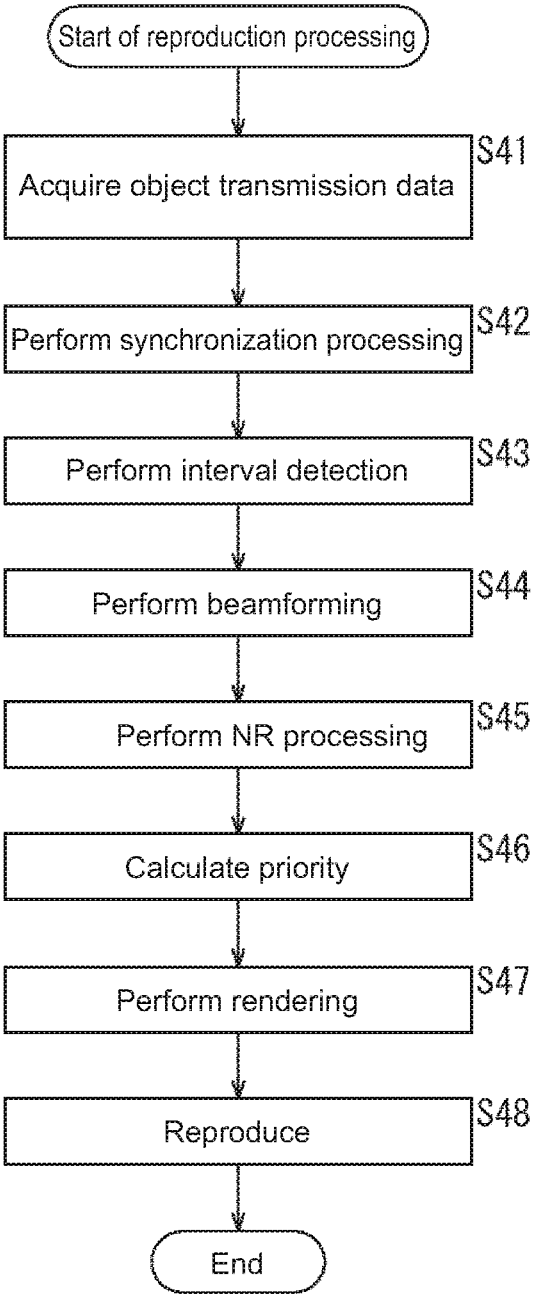
FIG. 9 is a flowchart for describing reproduction processing.

That is, in Step S103, processing similar to that in Step S47 of FIG. 9 is performed, and reproduction data is generated. When the information indicating the result of the interval detection or the type of the NR processing is supplied from the decoding unit 132, the information indicating the result of the interval detection or the type of the NR processing is used to determine the composite weight as necessary.

When the reproduction data is generated by the rendering, the rendering unit 165 supplies the obtained reproduction data to the reproduction unit 134. The reproduction unit 134 performs DA conversion or amplification processing on the reproduction data supplied from the rendering unit 165, and supplies the resulting reproduction data to the speaker 135.

After the reproduction data is supplied to the speaker 135, the processing of Step S104 is performed, and the reproduction processing is terminated. The processing of Step S104 is similar to the processing of Step S48 of FIG. 9, and thus description thereof will be omitted.

As described above, the reproduction apparatus 12 generates the reproduction data on the basis of the object obtained by the recording in each of the recording apparatuses 11, and reproduces sound in the listening position and the listening direction in the recording target space. In this case, the reproduction apparatus 12 does not need to particularly perform the interval detection, the beamforming, and the NR processing, and can thus reproduce sound of an optional listening position and listening direction with a high sense of reality, with a smaller amount of processing.

Note that also when the recording processing described with reference to FIG. 10 is performed in the recording apparatus 11, the reproduction processing described with reference to FIG. 9 may be performed in the reproduction apparatus 12 shown in FIG. 5.

SECOND EMBODIMENT

<Configuration Example of Sound Field Reproduction System>

While the case where each recording apparatus 11 individually transmits the object transmission data to the reproduction apparatus 12 has been described as an example, several pieces of object transmission data may be collected and transmitted together to the reproduction apparatus 12.

Figure 12:
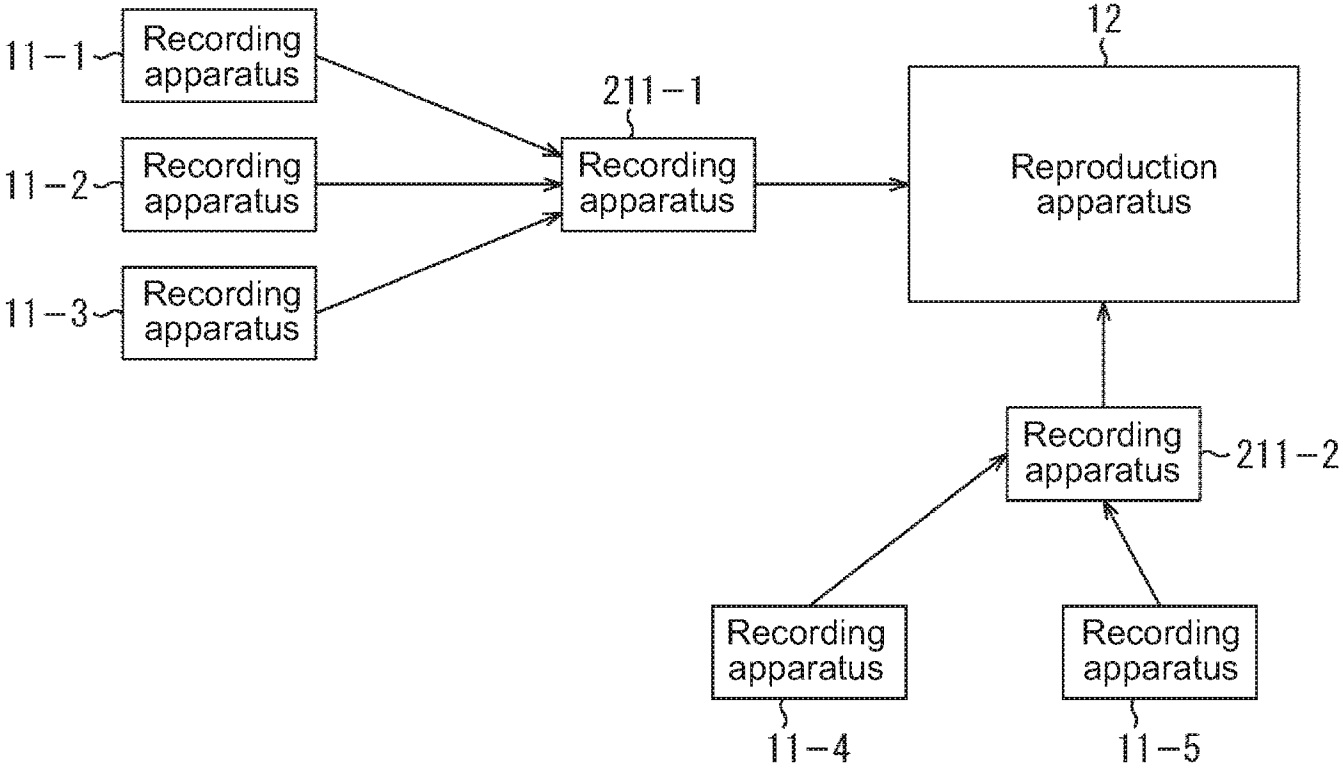
FIG. 12 is a diagram showing a configuration example of a sound field reproduction system.

In such a case, for example, the sound field reproduction system is configured as shown in FIG. 12. Note that portions in FIG. 12 that correspond to those in FIG. 1 will be denoted by the same reference numerals and description thereof will be omitted as appropriate.

The sound field reproduction system shown in FIG. 12 includes a recording apparatus 11-1 to a recording apparatus 11-5, a recording apparatus 211-1, a recording apparatus 211-2, and a reproduction apparatus 12.

Additionally, for the purpose of concrete description, it is assumed that the sound field reproduction system shown in FIG. 12 achieves the recording and reproduction of a sound field of the field in which a soccer game is being played.

In this case, for example, each recording apparatus 11 is attached to a soccer player. Additionally, the recording apparatus 211-1 and the recording apparatus 211-2 are attached to a soccer player, a referee, and the like. The recording apparatus 211-1 and the recording apparatus 211-2 also have a function for recording a sound field, which is similar to that of the recording apparatus 11.

Note that if it is not necessary to distinguish the recording apparatus 211-1 and the recording apparatus 211-2 from each other hereafter, they are also simply referred to as the recording apparatuses 211. Although an example in which two recording apparatuses 211 are disposed in the recording target space will be described here, any number of recording apparatuses 211 may be used.

On the field of soccer, which is the recording target space, the recording apparatuses 11 and the recording apparatuses 211 attached to the players, referees, and the like are discretely disposed.

Additionally, each of the recording apparatuses 211 acquires object transmission data from the recording apparatus 11 in the vicinity thereof.

In this example, the recording apparatus 11-1 to the recording apparatus 11-3 transmit object transmission data to the recording apparatus 211-1, and the recording apparatus 11-4 and the recording apparatus 11-5 transmit object transmission data to the recording apparatus 211-2.

Note that from which recording apparatus 11 each recording apparatus 211 receives the object transmission data may be determined in advance or may be dynamically determined. For example, if it is dynamically determined from which recording apparatus 11 the object transmission data is received, the recording apparatus 211 closest to the recording apparatus 11 may receive the object transmission data from that recording apparatus 11.

The recording apparatus 211 records the sound field to generate the object transmission data, selects the generated object transmission data and some pieces of the object transmission data received from the recording apparatuses 11, and transmits only the selected object transmission data to the reproduction apparatus 12.

Note that, in the recording apparatus 211, in the object transmission data generated by itself and the object transmission data received from one or more recording apparatuses 11, all the object transmission data may be transmitted to the reproduction apparatus 12, or only one or more pieces of object transmission data may be transmitted to the reproduction apparatus 12.

In selection of the object transmission data to be transmitted to the reproduction apparatus 12, for example, the selection may be performed on the basis of the moving body-related information included in each piece of object transmission data.

Specifically, for example, with reference to the sound collection position movement information of the moving body-related information, the object transmission data of the moving body a small amount of motion can be selected. In this case, the object transmission data of a high-quality object with less noise can be selected.

Additionally, for example, the object transmission data of the moving bodies located at positions apart from each other can be selected on the basis of the moving body position information of the moving body-related information. In other words, if there are multiple moving bodies in close proximity, only the object transmission data of one of those moving bodies can be selected. This can prevent similar objects from being transmitted to the reproduction apparatus 12 and can reduce the transmission amount.

Further, for example, the object transmission data of the moving bodies facing in different directions can be selected on the basis of the moving body orientation information of the moving body-related information. In other words, if there are multiple moving bodies facing in the same direction, only the object transmission data of one of those moving bodies can be selected. This can prevent similar objects from being transmitted to the reproduction apparatus 12 and can reduce the transmission amount.

The reproduction apparatus 12 receives the object transmission data transmitted from the recording apparatus 211, generates the reproduction data on the basis of the received object transmission data, and reproduces the sound in a predetermined listening position and listening direction.

In such a manner, the recording apparatus 211 collects the object transmission data obtained by the recording apparatuses 11 and selects object transmission data to be supplied to the reproduction apparatus 12 from the plurality of pieces of object transmission data. This can reduce the transmission amount of the object transmission data to be transmitted to the reproduction apparatus 12. Additionally, since the number of pieces of object transmission data to be transmitted to the reproduction apparatus 12 and the number of times of communication by the reproduction apparatus 12 are also reduced, the amount of processing in the reproduction apparatus 12 can also be reduced. Such a configuration of the sound field reproduction system is useful particularly in a case where the number of recording apparatuses 11 is large.

<Configuration Example of Recording Apparatus>

Note that the recording apparatus 211 may have a recording function similar to that of the recording apparatus 11 or may have no recording function and select the object transmission data to be transmitted to the reproduction apparatus 12 only from the object transmission data collected from the recording apparatuses 11.

Figure 13:
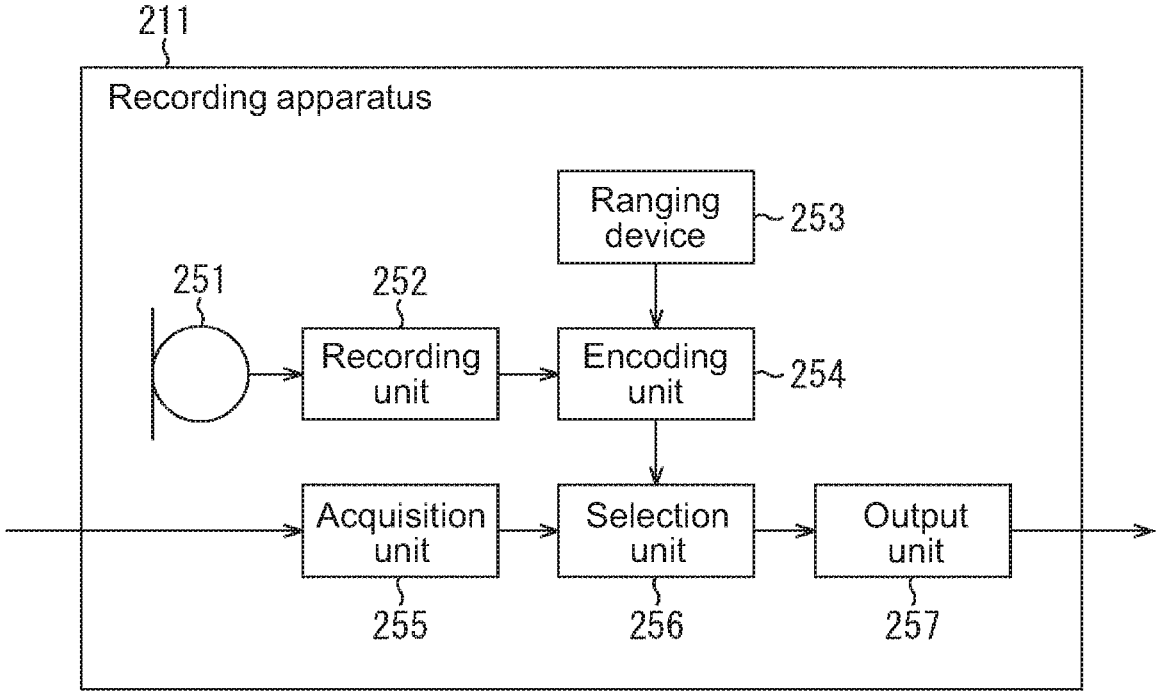
FIG. 13 is a diagram showing a configuration example of a recording apparatus.

For example, in a case where the recording apparatus 211 has a recording function, the recording apparatus 211 is configured as shown in FIG. 13.

The recording apparatus 211 shown in FIG. 13 includes a microphone array 251, a recording unit 252, a ranging device 253, an encoding unit 254, an acquisition unit 255, a selection unit 256, and an output unit 257.

Note that the microphone array 251 to the encoding unit 254 correspond to the microphone array 41 to the encoding unit 44 of the recording apparatus 11 and perform operations similar to those of the microphone array 41 to the encoding unit 44, and thus description thereof will be omitted.

The acquisition unit 255 receives the object transmission data wirelessly transmitted from the output unit 45 of the recording apparatus 11 to acquire (collect) the object transmission data from the recording apparatus 11, and supplies the acquired object transmission data to the selection unit 256.

The selection unit 256 selects one or more pieces of object transmission data to be transmitted to the reproduction apparatus 12, from one or more pieces of object transmission data supplied from the acquisition unit 255 and the object transmission data supplied from the encoding unit 254, and supplies the selected object transmission data to the output unit 257.

The output unit 257 outputs the object transmission data supplied from the selection unit 256.

For example, in a case where the output unit 257 has a wireless transmission function, the output unit 257 wirelessly transmits the object transmission data to the reproduction apparatus 12.

Additionally, for example, in a case where the recording apparatus 211 includes storage, the output unit 257 outputs the object transmission data to the storage and records the object transmission data in the storage. In this case, at an optional timing, the object transmission data recorded in the storage is directly or indirectly read by the reproduction apparatus 12.

By providing the recording apparatus 211 that collects the object transmission data of the recording apparatuses 11 and selects the object transmission data to be transmitted to the reproduction apparatus 12 as described above, the transmission amount of the object transmission data and the processing amount in the reproduction apparatus 12 can be reduced.

<Configuration Example of Computer>

Incidentally, the series of processing described above can be performed by hardware or software. In a case where the series of processing is performed by software, a program constituting the software is installed on a computer. Here, examples of the computer include a computer incorporated into dedicated hardware, and a computer such as a general-purpose personal computer capable of performing various functions by various programs installed thereon.

Figure 14:
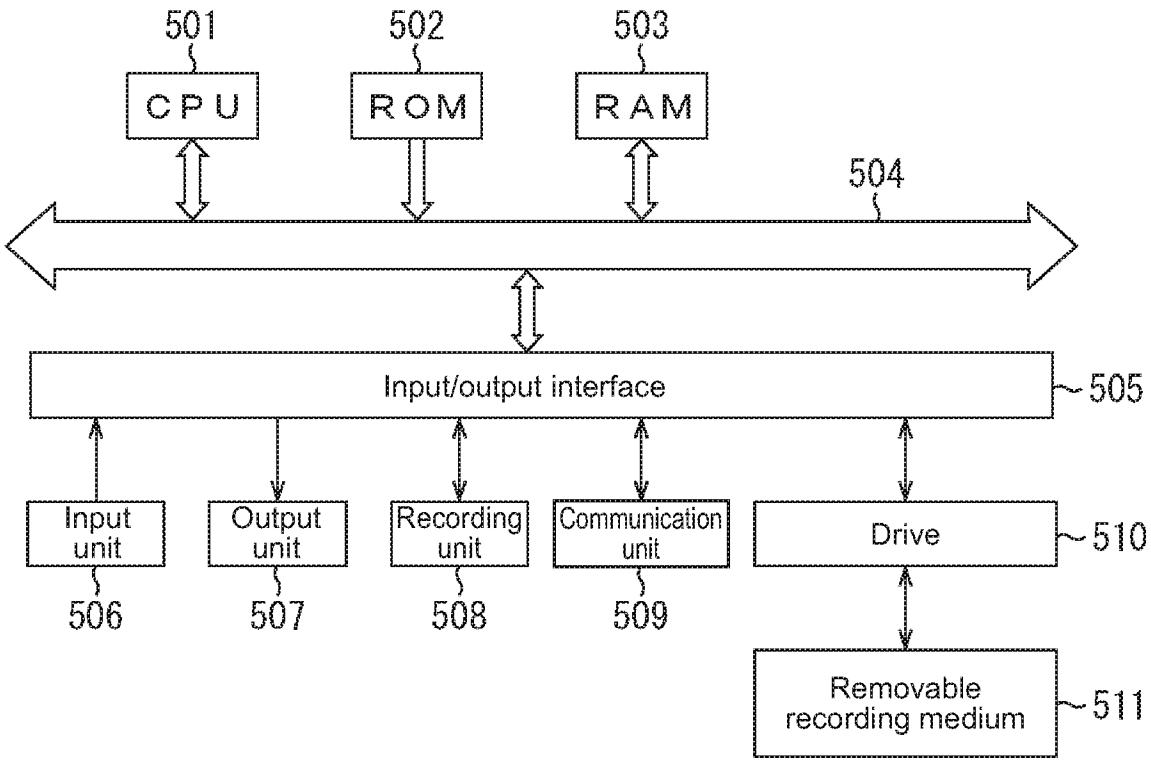
FIG. 14 is a diagram showing a configuration example of a computer.¥Mode(s) for Carrying Out the Invention Hereinafter, embodiments to which the present technology is applied will be described with reference to the drawings.

FIG. 14 is a block diagram of a configuration example of hardware of a computer that performs the series of processing described above using a program.

In the computer, a central processing unit (CPU) 501, a read only memory (ROM) 502, and a random access memory (RAM) 503 are connected to one another through a bus 504.

An input/output interface 505 is further connected to the bus 504. An input unit 506, an output unit 507, a recording unit 508, a communication unit 509, and a drive 510 are connected to the input/output interface 505.

The input unit 506 includes, for example, a keyboard, a mouse, a microphone, and an imaging device. The output unit 507 includes, for example, a display and a speaker. The recording unit 508 includes, for example, a hard disk and a nonvolatile memory. The communication unit 509 includes, for example, a network interface. The drive 510 drives a removable recording medium 511 such as a magnetic disk, an optical disc, a magneto-optical disk, or a semiconductor memory.

In the computer having the configuration described above, for example, the series of processing described above is performed by the CPU 501 loading a program stored in the recording unit 508 into the RAM 503 and executing the program via the input/output interface 505 and the bus 504.

For example, the program executed by the computer (CPU 501) can be provided by being recorded in the removable recording medium 511 serving as, for example, a package medium. Additionally, the program can be provided via a wired or wireless transmission medium such as a local area network, the Internet, or digital satellite broadcasting.

In the computer, the program can be installed on the recording unit 508 via the input/output interface 505 by the removable recording medium 511 being mounted on the drive 510. Additionally, the program can be received by the communication unit 509 via a wired or wireless transmission medium to be installed on the recording unit 508. Moreover, the program can be installed in advance on the ROM 502 or the recording unit 508.

Note that the program executed by the computer may be a program in which processing is chronologically performed in the order described herein, or may be a program in which processing is performed in parallel or processing is performed at a necessary timing such as a timing of calling.

Additionally, the embodiments of the present technology are not limited to the embodiments described above, and various modifications may be made thereto without departing from the gist of the present technology.

For example, the present technology may also have a configuration of cloud computing in which a plurality of apparatuses shares tasks of a single function and works collaboratively to perform the single function via a network.

Further, the steps described using the flowchart described above may be shared by a plurality of apparatuses to be performed, in addition to being performed by a single apparatus.

Moreover, when a single step includes a plurality of processes, the plurality of processes included in the single step may be shared by a plurality of apparatuses to be performed, in addition to being performed by a single apparatus.

Further, the present technology may have the following configurations.

(1) A signal processing apparatus, including a rendering unit that generates reproduction data of sound at an optional listening position in a target space on the basis of recording signals of microphones attached to a plurality of moving bodies in the target space.

(2) The signal processing apparatus according to (1), in which the rendering unit selects one or a plurality of the recording signals among the recording signals obtained for the respective moving bodies, and generates the reproduction data on the basis of the selected one or plurality of the recording signals.

(3) The signal processing apparatus according to (2), in which the rendering unit selects the recording signal to be used for generating the reproduction data on the basis of a priority of the recording signal.

(4) The signal processing apparatus according to (3), further including a priority calculation unit that calculates the priority on the basis of at least one of a sound pressure of the recording signal, a result of interval detection of target sound or non-target sound with respect to the recording signal, a type of noise reduction processing performed on the recording signal, a position of the moving body in the target space, a direction in which the moving body faces, information related to motion of the moving body, the listening position, a listening direction in which a virtual listener at the listening position faces, information related to motion of the listener, or information indicating a specified sound source.

(5) The signal processing apparatus according to (4), in which the priority calculation unit calculates the priority such that the recording signal of the moving body closer to the listening position has a higher priority.

(6) The signal processing apparatus according to (4) or (5), in which the priority calculation unit calculates the priority such that the recording signal of the moving body having a smaller amount of movement has a higher priority.

(7) The signal processing apparatus according to any one of (4) to (6), in which the priority calculation unit calculates the priority such that the recording signal having less noise has a higher priority, on the basis of the result of the interval detection or the type of the noise reduction processing.

(8) The signal processing apparatus according to any one of (4) to (7), in which the priority calculation unit calculates the priority such that the recording signal not including the non-target sound has a higher priority on the basis of the result of the interval detection.

(9) The signal processing apparatus according to (8), in which the non-target sound is an utterance sound of a predetermined no good word, a rubbing sound of clothing, a vibration sound, a contact sound, a wind noise, or a noise sound.

(10) The signal processing apparatus according to any one of (4) to (9), in which the rendering unit generates the reproduction data by weighting and adding the selected one or plurality of the recording signals on the basis of at least one of the priority, the sound pressure of the recording signal, the result of the interval detection, the type of the noise reduction processing, the position of the moving body in the target space, the direction in which the moving body faces, the information related to the motion of the moving body, the listening position, the listening direction, the information related to the motion of the listener, or the information indicating the specified sound source.

(11) The signal processing apparatus according to (10), in which the rendering unit generates the reproduction data of the listening direction at the listening position.

(12) A signal processing apparatus, including generating, by a signal processing apparatus, reproduction data of sound at an optional listening position in a target space on the basis of recording signals of microphones attached to a plurality of moving bodies in the target space.

(13) A program that causes a computer to execute processing including the step of generating reproduction data of sound at an optional listening position in a target space on the basis of recording signals of microphones attached to a plurality of moving bodies in the target space.

REFERENCE SIGNS LIST

11-1 to 11-5, 11 recording apparatus
12 reproduction apparatus
133 signal processing unit
134 reproduction unit
162 interval detection unit
163 beamforming unit
164 NR unit
165 rendering unit
181 priority calculation unit

The invention claimed is:

1. A signal processing apparatus, comprising:

a priority calculation unit configured to calculate a priority of each recording signal of a plurality of recording signals based on at least one of a sound pressure of the each recording signal, a result of interval detection of target sound with respect to the each recording signal or non-target sound with respect to the each recording signal, a type of a noise reduction process on the each recording signal, a position of a corresponding moving body of the plurality of moving bodies in a target space, a direction in which the corresponding moving body faces, information related to motion of the corresponding moving body, an optional listening position, a listening direction in which a virtual listener at the optional listening position faces, information related to motion of the virtual listener, or information indicating a specified sound source, wherein the plurality of recording signals corresponds to a plurality of microphones, and each microphone of the plurality of microphones is attached to a respective moving body of a plurality of moving bodies in the target space; and a rendering unit configured to:

select at least one recording signal of the plurality of recording signals based on the calculated priority of each recording signal of the plurality of recording signals; and generate reproduction data of sound at the optional listening position in the target space based on the selected at least one recording signal.

2. The signal processing apparatus according to claim 1, wherein the plurality of recording signals includes a first recording signal corresponding to a first moving body of the plurality of moving bodies, and a second recording signal corresponding to a second moving body of the plurality of moving bodies, the first recording signals has a higher priority than the second recording signal, and the first moving body is closer to the optional listening position than the second moving body.

3. The signal processing apparatus according to claim 1, wherein the plurality of recording signals includes a first recording signal corresponding to a first moving body of the plurality of moving bodies, and a second recording signal corresponding to a second moving body of the plurality of moving bodies, the first recording signals has a higher priority than the second recording signal, and the first moving body has a smaller amount of movement than the second moving body.

4. The signal processing apparatus according to claim 1, wherein the priority calculation unit is further configured to calculate the priority of each recording signal of the plurality of recording signals based on a result of at least one of the result of the interval detection or the type of the noise reduction process, the plurality of recording signals includes a first recording signal that has a higher priority than a second recording signal of the plurality of recording signals, and the first recording signal has less noise than the second recording signal.

5. The signal processing apparatus according to claim 1, wherein the priority calculation unit is further configured to calculate the priority of each recording signal of the plurality of recording signals based on the result of the interval detection, the plurality of recording signals includes a first recording signal that has a higher priority than a second recording signal of the plurality of recording signals, the non-target sound is absent in the first recording signal, and the second recording signal includes the non-target sound.

6. The signal processing apparatus according to claim 5, wherein the non-target sound is an utterance sound of at least one of a no good word, a rubbing sound of clothing, a vibration sound, a contact sound, a wind noise, or a noise sound.

7. The signal processing apparatus according to claim 1, wherein the rendering unit is further configured to:

select a set of recording signals of the plurality of recording signals;

determine a weight of each recording signal of the set of recording signals based on at least one of the priority, the sound pressure of the each recording signal, the result of the interval detection, the type of the noise reduction process, the position of the corresponding moving body in the target space, the direction in which the corresponding moving body faces, the information related to the motion of the corresponding moving body, the optional listening position, the listening direction, the information related to the motion of the virtual listener, or the information indicating the specified sound source; and generate the reproduction data based on the determined weight and addition of the set of recording signals.

8. The signal processing apparatus according to claim 7, wherein the rendering unit is further configured to generate the reproduction data of the listening direction of the virtual listener at the optional listening position.

9. A signal processing method, comprising:

calculating a priority of each recording signal of a plurality of recording signals based on at least one of a sound pressure of the each recording signal, a result of interval detection of target sound with respect to the each recording signal or non-target sound with respect to the each recording signal, a type of a noise reduction process on the each recording signal, a position of a corresponding moving body of the plurality of moving bodies in a target space, a direction in which the corresponding moving body faces, information related to motion of the corresponding moving body, an optional listening position, a listening direction in which a virtual listener at the optional listening position faces, information related to motion of the virtual listener, or information indicating a specified sound source, wherein the plurality of recording signals corresponds to a plurality of microphones, and each microphone of the plurality of microphones is attached to a respective moving body of a plurality of moving bodies in the target space;

selecting at least one recording signal of the plurality of recording signals based on the calculated priority of each recording signal of the plurality of recording signals; and generating reproduction data of sound at the optional listening position in the target space based on the selected at least one recording signal.

10. A non-transitory computer-readable medium having stored thereon computer-executable instructions which, when executed by a computer, cause the computer to execute operations, the operations comprising:

calculating a priority of each recording signal of a plurality of recording signals based on at least one of a sound pressure of the each recording signal, a result of interval detection of target sound with respect to the each recording signal or non-target sound with respect to the each recording signal, a type of a noise reduction process on the each recording signal, a position of a corresponding moving body of the plurality of moving bodies in a target space, a direction in which the corresponding moving body faces, information related to motion of the corresponding moving body, an optional listening position, a listening direction in which a virtual listener at the optional listening position faces, information related to motion of the virtual listener, or information indicating a specified sound source, wherein the plurality of recording signals corresponds to a plurality of microphones, and each microphone of the plurality of microphones is attached to a respective moving body of a plurality of moving bodies in the target space;

selecting at least one recording signal of the plurality of recording signals based on the calculated priority of each recording signal of the plurality of recording signals; and generating reproduction data of sound at the optional listening position in the target space based on the selected at least one recording signal.

* * * * *